US005778608A

United States Patent [19]

Elliott, Jr.

[11] Patent Number: 5,778,608

[45] Date of Patent: Jul. 14, 1998

[54] VAULTED UNDERGROUND STORAGE TANK

[75] Inventor: Thomas P. Elliott, Jr., Katy, Tex.

[73] Assignee: Dalworth Concrete Products, Inc., Katy, Tex.

[21] Appl. No.: 611,462

[22] Filed: Mar. 4, 1996

Related U.S. Application Data

[63] Continuation-in-part of Ser. No. 381,272, Jan. 31, 1995, Pat. No. 5,495,695.

[51] Int. Cl.[6] ..... E04C 3/10; E04D 29/14

[52] U.S. Cl. ..... 52/79.9; 52/20; 52/167.3; 52/169.6; 52/169.7; 52/741.12; 52/741.3; 52/745.01; 220/565; 405/53

[58] Field of Search ..... 52/167.1, 167.3, 52/167.4, 169.1, 169.6, 169.7, 19–21, 135, 138, 79.1, 79.9, 741.11–741.13, 741.3, 745.01; 220/565; 405/52, 53

[56] References Cited

U.S. PATENT DOCUMENTS

| | | |
|---|---|---|
| 26,481 | 12/1859 | Doyere . |
| 761,548 | 5/1904 | Sheaff . |
| 1,188,446 | 6/1916 | Haines . |
| 1,520,230 | 12/1924 | Flath . |
| 1,958,487 | 5/1934 | Moran . |
| 2,095,256 | 10/1937 | Horton . |
| 2,136,390 | 11/1938 | McHugh . |
| 2,166,913 | 7/1939 | Little . |

(List continued on next page.)

FOREIGN PATENT DOCUMENTS 1301744 4/1987 U.S.S.R. .

OTHER PUBLICATIONS

"Surevault", S.C.V. Corp., Product Brochure and Specifications, 5 pages, Aug. 10, 1990.

"Ecovault—Engineered for the Environment", UNISIL, Inc. Product Brochure, 4 pages.

General Specifications, Sannipoli Corp., 1 page, Date not Listed.

"Petro Vault—There is no Equal", Product Brochure, 2 pages, Date Not Listed.

"Above Ground Storage!", We Dland Mfg. Co., 1 page, Date Not Listed.

"Enviro–Vault", B.R.E. Products, Inc. Product Brochure, Installation Instructions, Specifications and Related Papers, Multiple pages, Aug. 27, 1990.

Robert P. Ouellette, The Underground Storage Tank Market, Jan./Feb. 1992.

"Best Above Ground Fuel Storage Tank", Trusco Tank, Inc., Supervault Product Brochure, Price List and Specifications, Multiple pages, Date Not Listed.

"Hi–Tech Vaults", Hausner's, Inc. Product Advertisement and Features, 3 pages, Date Not Listed.

"Surevault", S.C.V. Corp. Product Brochure and Specifications, 5 pages, Date Not Listed.

"Lube Cube Vault Tank", Hoover Group, Inc. Advertisement and Specifications, 2 pages, Date Not Listed.

*Primary Examiner*—Robert Canfield

*Attorney, Agent, or Firm*—Knobbe, Martens, Olson & Bear, LLP

[57] ABSTRACT

An improved storage system and a method of constructing the storage system adaptably satisfies structural requirements in different seismic zones. The storage system is efficiently constructed to restrain movement of a storage tank within a vault, even if the storage tank is positioned such that all sides of the tank are not physically accessible. Within the outer containment vault, a plurality of structural members and bottom restraints restrict movement of a storage tank relative to the vault. The structural member has two depending restraints, one on each side of the storage tank to wedge the storage tank in place. Additionally, the bottom restraints are structurally connected to the bottom of the vault and positioned in close proximity to the side of the tank to further restrain movement of the tank. Different sized storage systems may be constructed in compliance with seismic requirements by modifying the number and size of the structural members and bottom restraints within a particular storage system.

39 Claims, 8 Drawing Sheets

U.S. PATENT DOCUMENTS 2,331,483 10/1943 Lawman et al. .
2,333,315 11/1943 Klingberg .
2,341,547 2/1944 Heineman .
2,398,828 4/1946 Gray .
2,408,105 9/1946 Starret .
2,507,597 5/1950 Holdridge .
2,531,742 11/1950 Pomykala .
2,544,828 3/1951 Dobell .
2,629,348 2/1953 Kifferstein .
2,931,211 4/1960 McCullough .
2,984,898 5/1961 Svensson .
3,314,567 4/1967 Becker et al. .
3,429,473 2/1969 Vroman et al. .
3,448,885 6/1969 Parks .
3,464,175 9/1969 Akita et al. .
3,471,599 10/1969 Archer .
3,481,504 12/1969 Nelson .
3,545,213 12/1970 Sebor et al. .
3,562,977 2/1971 Alleaume .
3,640,038 2/1972 Heron .
3,672,103 6/1972 Kost .
3,848,765 11/1974 Durkop .
3,995,472 12/1976 Murray .
4,110,947 9/1978 Murray et al. .
4,153,103 5/1979 Bachli .
4,183,221 1/1980 Yamamoto .
4,233,789 11/1980 Dinardo .
4,242,847 1/1981 Rezin .
4,366,654 1/1983 Bomhard .
4,425,743 1/1984 Bartur .
4,581,199 4/1986 Biroet et al. ..... 52/167.4 X
4,607,522 8/1986 Sharp .
4,638,920 1/1987 Goodhues, Jr. .
4,653,312 3/1987 Sharp .
4,717,285 1/1988 Pulkkinen .
4,776,138 10/1988 Sumner et al. .
4,787,772 11/1988 Wagner .
4,826,644 5/1989 Lindquist et al. .
4,869,033 9/1989 Duvieusart et al. .
4,931,235 6/1990 Lindquist et al. .
4,934,122 6/1990 Lindquist .
4,950,105 8/1990 Meess et al. .
4,960,151 10/1990 Kaminski et al. .
4,961,293 10/1990 House et al. .
4,963,082 10/1990 Lindquist et al. .
4,978,249 12/1990 Killman .
4,986,436 1/1991 Bambacigno et al. .
5,037,239 8/1991 Olsen et al. .
5,045,327 9/1991 Tarlow et al. .
5,064,155 11/1991 Bambacigno et al. ..... 52/169.1 X
5,090,713 2/1992 Johnson .
5,157,888 10/1992 Lindquist .
5,495,695 3/1996 Elliot, Jr. ..... 52/20

VAULTED UNDERGROUND STORAGE TANK

This is a continuation-in-part of application Ser. No. 08/381,272 filed Jan. 31, 1995, now U.S. Pat. No. 5,495,695, issued Mar. 5, 1996.

BACKGROUND OF THE INVENTION

The present invention relates to an underground facility for the storage of liquids and, more particularly, to a fuel storage tank within a segmentalized precast concrete vault, the assembly having a highly efficient fuel storage capacity to overall displacement volume ratio.

Underground storage tanks are frequently used for the storage of various liquids, such as gasoline, fuel oil, diesel oil, toxic fluids or various chemicals. These underground storage tanks are used in retail automobile service stations, truck and bus depots, for various industrial and commercial facilities, and occasionally, for homes and consumer purposes. The storage tanks are generally tubular, consist of a welded construction of sheet steel of sufficient gauge, and have a capacity ranging from 500–50,000 gallons.

For some time the Environmental Protection Agency (EPA) has recognized that the United States faces a costly underground storage and pollution problem. The old methods of storing liquids, chemicals and hazardous materials are not acceptable. Gasoline stations, for example, previously used single-wall direct bury tanks for their on-site gasoline storage. After a relatively short time, these underground storage tanks leak—contaminating the ground water in the surrounding land and endangering the public. Detecting these leaks is difficult and usually only occurs after gasoline has been leaking for a considerable time. Replacing or repairing these underground tanks is very expensive and time-consuming. More recently, some tanks have been made of fiberglass, but such tanks are subject to cracking or other problems which cause these tanks to leak also.

As existing underground tanks are, on average, 25 years old, and as the risk of leaks increases substantially after 12 years, it is currently estimated that up to about 20% of underground storage tanks are probably leaking. In view of concerns regarding environmental problems associated with leaking underground storage tanks, some years ago the EPA adopted regulations requiring regular leakage testing of underground storage tanks and the carrying of insurance policies or providing evidence of financial responsibility to cover the cost of any required environmental clean-up. Complying with these regulations has significantly added to the cost and responsibility of owning and operating underground storage tanks. In many cases, the required insurance, if available at all, is so expensive that independent gas station owners cannot afford it.

The EPA's regulations do not apply, however, when the storage tanks themselves are not directly buried but are placed within a structure or vault where they can be inspected and where any leakage can be contained. Hence, placing storage tanks within a structure, either above ground or underground, is a way to both gain exclusion from EPA regulations and prevent environmental problems. In addition, contamination concerns of financiers and future land owners, as well as the potentially crippling expense of contamination clean-up, are alleviated with the use of a storage tank within an enclosing structure.

To qualify for the EPA underground storage tank regulation exclusion, the tank must be situated upon or above the surface of the floor of an underground area such that inspection for leaks is possible. However, an inspector must first gain access to an underground vault to visually inspect the exterior of an enclosed tank. In order to comply with OSHA (Occupational Safety and Health Administration) access regulations, there is a minimum access ladder area width requirement of 30 inches and at least an 18 inches wide confined access space between the sides of the tank and vault is required.

U.S. Pat. No. 4,638,920 issued to Goodhues, Jr., U.S. Pat. No. 4,961,293 to House, et al. and U.S. Pat. No. 5,037,239 to Olsen, et al. disclose underground concrete vault structures designed to enclose hazardous liquid storage tanks. These patents show tubular tanks within generally rectangular parallelepiped vaults where a certain amount of space or clearance is left around the vaults to provide for access and visual inspection.

In urban areas, it is common for service stations and convenience store facilities to be located on an expensive, busy intersection site where rights of way and utility easements are enlarged as the area develops. Frequently, these public acquisitions result in tank encroachments that must be resolved. Typically, an aging storage tank which is positioned partially in a public easement space must be replaced due to leaking. Once the owner has removed the existing tank and/or vault, the city or municipality often refuses to allow the space within the public easement to be used when situating a new tank.

Unfortunately, this problem cannot always be overcome by digging a deeper hole in the ground to install a taller tubular vault. Depending on the local geology, the water table may be from 2 feet deep in coastal areas to around 15 feet deep inland. Safety regulations become stiffer when digging below the water table due to the extra shoring needed and larger excavation machines to reach deeper below ground. Thus, digging deeper becomes more expensive and is often not a viable alternative.

Prior underground vaulted tanks have exclusively utilized horizontal tubular internal tanks, common in the retail gasoline industry. Tubular tanks are considerably cheaper to manufacture than other configurations. It is well-known that a round internal tank is more economical than other shaped tanks to contain liquids because of the reduced stresses inherent in the design. However, the concrete vaults surrounding the internal tank are typically constructed with rectangular cross sections due to the ease of digging similarly-shaped holes in the ground and forming concrete in flat walls rather than round walls, as well as the need to provide a flat surface as a platform for inspection access.

Other drawbacks are also associated with the installation of existing underground vaulted tanks. Assuming the assembly of an outer square cross-section concrete vault pre-cast in pieces, the difficulties associated with transportation of such large pieces becomes significant. There are restrictions on trucking capacity, not only for traffic safety, but also because the roads have a maximum load bearing strength. Furthermore, the cranes used to lift the pieces onto waiting trucks and then to unload the concrete sections have a maximum tonnage lift capacity. There is typically a maximum crane size which is practical for on-site installation, thus limiting the possible site access.

One example of an existing vaulted tank is a 10,000 gallon storage capacity unit manufactured and sold by Secondary Containment Vaults (SCV) of San Antonio, Tex. under the trademark SUREVAULT. The vault portion consists of six prestressed, precast units: a bottom unit, a collar unit and a cover comprised of four flat panels. The storage tank is a cylinder having a length of approximately 28 feet and a diameter of 8 feet. The outer dimensions of the rectangular vault are 31'-8" by 12'-0" by 11'-8.5". The largest component is the bottom unit which forms a cradle for the tank and weighs 79,300 lbs. Disadvantageously, most states require special trucking permits for loads greater than 50,000 lbs and, in order to transport such a large piece, an escort vehicle may be necessary. Furthermore, a crane having an 140 ton capacity would be needed to lift the largest piece safely at a 25' reach, and such a crane typically rents for a steep hourly rate as compared to a smaller sized crane having a 65 ton capacity. For instance, in one region, crane rental rates for a 140 ton crane are 175% of the cost of a 65 ton crane.

Rectangular parallelepiped tanks encased in concrete are presently used for above-ground tank installation. The primary purpose of the concrete encasement of an above-ground tank is to provide fire protection. However, the concrete encasement also provides secondary fuel containment. Typically, the clearance between the concrete and the inner tank varies from approximately ¼ inch to 2 inches to serve as a space for allowing free transport of any primary tank leakage to a lower point where the leakage can be readily sensed by various means of leak detection. These designs neither permit, nor do they meet EPA standards for visual inspection of, or OSHA standards for physical access, to the tank.

Despite the fact that rectangular tanks cost approximately twice as much to build as a tubular tank, rectangular internal tanks are used in rectangular above-ground vaults because the exterior concrete that encases the interior tank can more easily be monolithically cast, thereby eliminating the need for joints in the concrete which present sealing, and therefore potential fire, problems. Examples of such above-ground storage tanks are shown in U.S. Pat. Nos. 4,931,235 and 4,934,122. This type of fire risk is not significant in the underground tank environment.

There is currently a need for an improved underground storage tank within an access vault which addresses the limitations of the prior art.

Additionally, underground concrete vaulted structures for containing liquid storage tanks are manufactured and shipped to customers in various parts of the country. The seismic load requirements in each region may differ substantially from region to region due to variations in location and structural requirements. For example, vaults installed in California might require more restraints or reinforcements to satisfy earthquake code requirements than is required in other states, such as those in the Midwest region. Therefore, the underground storage system must be designed to comply with the different requirements in each seismic zone.

Generally, to satisfy the varying requirements in each seismic zone, internal reinforcements are added to the vessel to prevent the vessel from flexing or moving within the vault. If the vessel flexes too much or hits the outer walls of the vault, the tank and vault walls may crack and leak hazardous liquid, thereby contaminating the surrounding groundwater.

It is economically inefficient to design, manufacture, and construct each storage system in compliance with the requirements for the most stringent seismic area. It is likewise economically inefficient to utilize different internal bracing in each geographic region. Thus, a need exists for a storage system and an efficient method of construction which takes into account different seismic load requirements, yet is cost efficient to manufacture and easy to construct.

SUMMARY OF THE INVENTION

The present invention provides an improved underground vaulted storage tank for hazardous liquids. A rectangular parallelepiped shaped internal hazardous liquid storage tank is installed within an external rectangular parallelepiped concrete vault with a sufficient amount of space left on two of the four sides for visual inspection of the internal tank and a sufficient amount of space left on the other two sides for physical access to the internal tank. The internal tank may be constructed of steel or other materials and, desirably, has openings as required for piping connections to fill, vent, or pump from the tank. The external vault provides a structure which serves as a means to hold back the soil, keep the internal tank free from contact with water and corrosive elements, and provide an accessible space to readily inspect and/or repair the internal tank.

Advantageously, land area used to install the vault for the underground storage tank is minimized because of the overall size of the vault compared with a vault used to store a comparably sized tank of the prior art. In addition, the excavation size is reduced, therefore reducing digging costs. Another benefit is the reduction in the volume of materials required to construct the vault due to the reduced overall size. Finally, transportation costs are reduced due to the size reduction of the underground storage vault components.

In a preferred embodiment, the external vault is precast in four main sections. A bottom section comprises a flat bottom with four upstanding walls around the periphery. The bottom is approximately one- to two-thirds the total height of the vault and may have a square horizontal cross section or a cross section longer in one dimension than the other, preferably in a ratio of approximately 1.25:1. Preferably, the bottom is between 3 and 6 feet in height and, more preferably, has a height of 4'-9". The horizontal cross section is between 10–22 feet long (advantageously 10–17 feet long) and between 8–14 feet wide and, desirably is 16'-4"×13'-4" in cross section.

One or more rectangular tubular sections of the same peripheral dimensions as the bottom mount on top of the bottom section with a mating groove around the edges. A top cover of between 6 and 12 inches in thickness fits over the top edge of the upper square tubular member to complete the sealed box-shaped structure. The rectangular tubular sections are between approximately 2 and 6 feet in height resulting a total vault height of between 8 and 16 feet.

The present invention contemplates construction of various sizes of underground storage vaults enclosing tanks having storage capacities of 4,000 gallons to 10,000 gallons and above. The horizontal cross sections of the storage tanks are preferably constant for all capacities, the tanks thus having varying heights. Preferably, the internal tank horizontal cross-section dimensions are approximately 108"×156", and the height varies from approximately 56" to 138". The storage tanks are preferably fabricated of between 3/16"and ¼" ASTM A-36 steel plate. The system may be provided with just one primary tank or with a primary tank and an outer tank for secondary liquid containment. Both primary and secondary tanks are preferably Underwriters Laboratories 142 Listed tanks for storage of flammable liquids.

The present invention advantageously makes use of some part interchangeability between the different capacity storage vaults. For instance, the same bottom portions and covers may advantageously be used for all of the different sizes of tanks with varying heights and numbers of square tubular members placed between the bottom member and cover. Desirably, the bottom section has a total height of 4'–9" and the cover is 9 inches thick.

In accordance with a preferred construction, the external vault for a 4,000-gallon storage tank system may have a bottom section and one 3-foot tall square tubular section topped with a cover for a total height of 8'–6". A 6,000-gallon capacity storage tank system may have an external vault with a similar bottom section and a 5 foot tall square tubular member with a cover on top for a total height of 10'–6". An 8,000-gallon storage tank system includes an identical bottom section, with a lower 5 foot tall square tubular section and an upper 3-foot square tubular section onto which the cover is placed for a total height of 13'–6". A 10,000-gallon capacity storage tank system may have an external vault with a 4'–9" tall bottom section, two 5 foot tall square tubular sections and a cover on top for a total height of 15'–6". All of these different sized underground storage tanks thus advantageously utilize some of the same components, saving costs, while the horizonal cross section of the vault remains constant and the height of the vault changes.

Each of the various sized storage tanks desirably includes an upper tubular tank man-way extending from the top surface of the tank to the cover of the external vault. A gasketed vault man-way in the cover allows access to the cylindrical tank man-way for an inspector to view the interior of the storage tank. Additionally, a second vault man-way, desirably having a diameter of 30 inches, is provided in the cover of the external vault. This second vault man-way provides access to the clearance space within the external vault and around the internal tank. Preferably, the gasketed vault man-way is disposed proximate a corner of the vault. Steel steps are desirably provided on the interior of the vault adjacent the second man-way to allow an inspector to descend to the bottom of the vault.

In a preferred embodiment, a first physical access gap is provided between the internal storage tank and the external vault along one side wall, and is desirably between 12" and 30" wide. Preferably the first physical access gap is between 18" and 24" and, more preferably, the gap is 18" wide. In addition, a second physical access gap is provided along a second side wall between the vault and tank and is desirably between 20" and 40" wide, and preferably is 30" wide. Additionally, a first visual inspection gap along a third side wall between the vault and tank is provided. The first visual inspection gap is desirably between 2" and 10" wide, and preferably the gap is 6" wide. Desirably, the tank is situated such that a second visual inspection gap is provided along a fourth side wall between the vault and tank and is between 2" and 10" wide, and preferably 6" wide. Desirably, the 18-inch first physical access gap is adjacent one of the short sides of the tank and the 30-inch second physical access gap is adjacent one of the long sides of the rectangular storage tank.

In accordance with the preferred storage vault and tank, a secondary tank is provided and the vault provides a tertiary containment structure. The primary and secondary storage tanks comprise spaced apart steel sheets while the tertiary vault containment is provided by a narrow strip of a material such as Hypalon, manufactured by Dupont, epoxied across the internal cracks between vault sections. Additionally, a watertight joint sealant between the sections is provided to prevent ground water intrusion. Other arrangements with only a primary storage tank provided and either no secondary fuel containment seal or a cast-in polymer liner for secondary containment are contemplated.

Pre-cast, steel or assembled risers of approximately 2 inches in height are desirably placed at spaced intervals underneath the internal storage tank to lift the storage tank above the floor of the vault and allow for sensing of any leaking substances underneath the tank. Furthermore, the tank is desirably anchored to the floor of the vault to satisfy earthquake code requirements and resist internal tank float-up.

The present invention further provides an improved storage system and an efficient method of constructing a storage system which is easily alterable to satisfy different seismic zone requirements. Furthermore, it advantageously provides a modular storage system which may be efficiently manufactured, transported, and constructed.

In an embodiment of the present invention, the storage system comprises a vault, a storage tank positioned within the vault and a structural member positioned within the vault to restrict the movement of the storage tank relative to the vault. The structural member is positioned above and across the storage tank with each end attached to one of a pair of opposing walls of the vault.

The structural member comprises a first restraint and a second restraint attached to and depending from a rigid beam, preferably made of steel. The first and second depending restraints are spaced apart along the beam a distance not less than the width of the storage vessel such that the storage tank is restrained between the two depending restraints. In a preferred embodiment, the depending restraints are spaced apart along the beam a distance slightly greater than the width of the storage tank so that the depending restraints form a slip fit with the tank.

Advantageously, a surface of each of the depending restraints is generally form-fitted or shaped to complement a portion of the outer surface of the storage tank. In a preferred embodiment, where the tank is box-shaped, the depending restraints each comprise a planar surface adjacent to the storage tank.

When the structural member is positioned within the vault, the first depending restraint and the second depending restraint advantageously wedge the storage tank in place. If the tank moves horizontally toward the first restraint, the tank will contact the first depending restraint, thus restricting movement of the storage tank in that direction. Likewise, if the tank moves horizontally in the opposite direction toward the second restraint, the second depending restraint will restrict horizontal movement of the storage tank in that direction. In addition, the lower surface of the beam is preferably in frictional contact with the top surface of the tank. Thus, even though the tank is not bolted, welded, or otherwise fixed to the beam or the depending restraints, the tank is restrained in place.

Advantageously, movement of the bottom of the tank may be restricted without physically accessing all sides of the tank. One or more bottom restraints are attached to the bottom of the vault to further restrict movement of the storage tank relative to the vault. The bottom restraints are positioned along at least one side of the storage tank, within close proximity to the tank, and attached to the bottom of the vault. In a preferred embodiment, the bottom restraints each comprise a first section fixed to the bottom of the vault and a second section defining an extending surface sized and shaped to complement the outer surface of a portion of the storage tank.

In one embodiment, a plurality of bottom restraints are positioned along one side and attached to the storage tank. Therefore, when the tank is subjected to seismic forces, the bottom restraints restrain movement of the tank.

In an alternative embodiment, a set of bottom restraints is positioned along one side of the tank and a second set of bottom restraints is positioned along the opposite side of the tank. The tank is thus wedged between the two sets of bottom restraints, thereby eliminating the need to attach the tank to the bottom restraints.

In a further alternative embodiment, one or more spacers are positioned between one side of the tank and one of the vault walls. A plurality of bottom restraints are positioned alongside and in close proximity to the opposite side of the tank. Advantageously, the spacers prevent movement of the tank in one direction and the bottom restraints prevent movement in the opposite direction.

DESCRIPTION OF THE PREFERRED EMBODIMENTS

Figure 1:
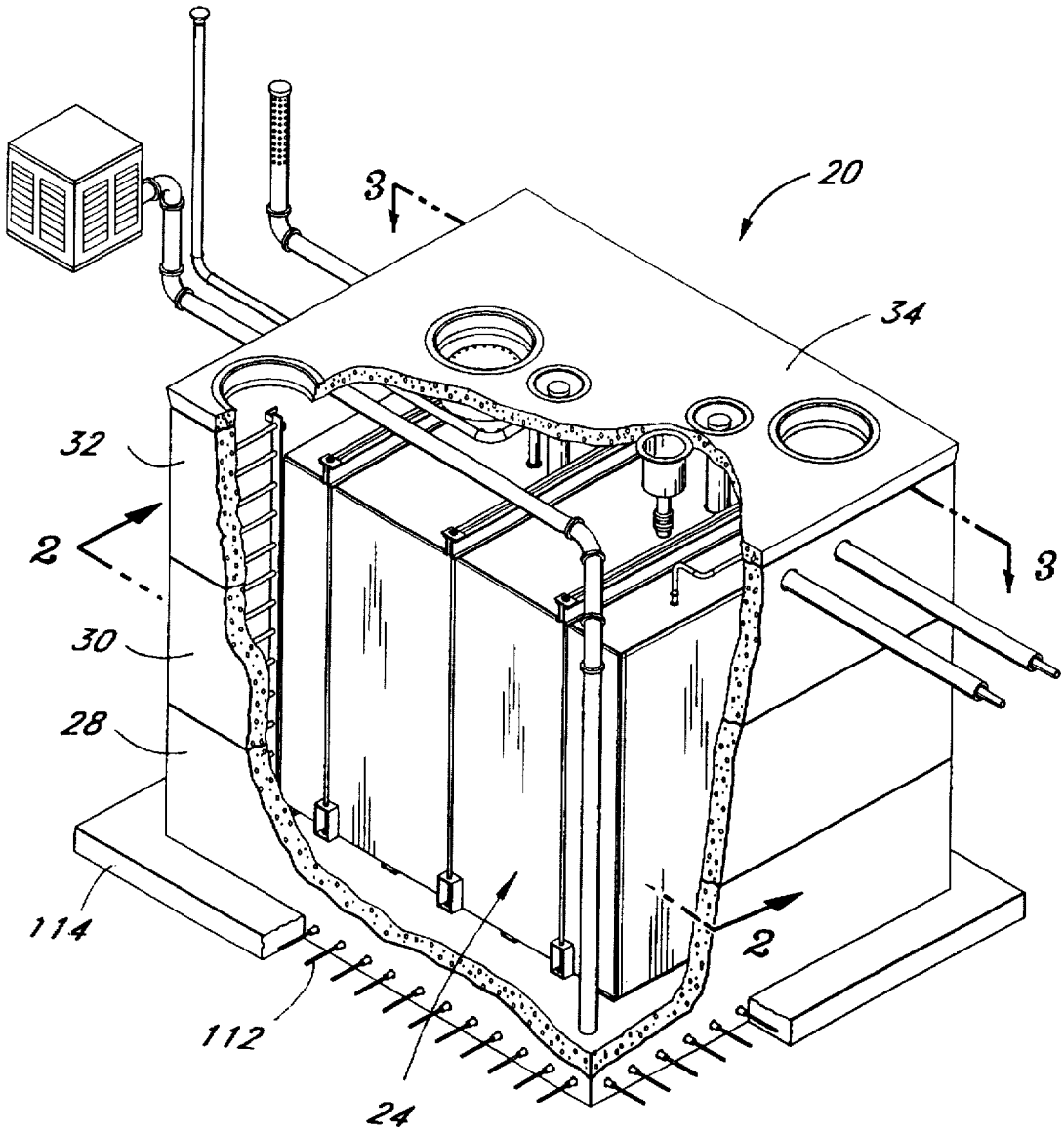
FIG. 1 is a partially cutaway perspective view of the underground storage tank and vault system of the present invention having a vault in four sections.
Figure 2:
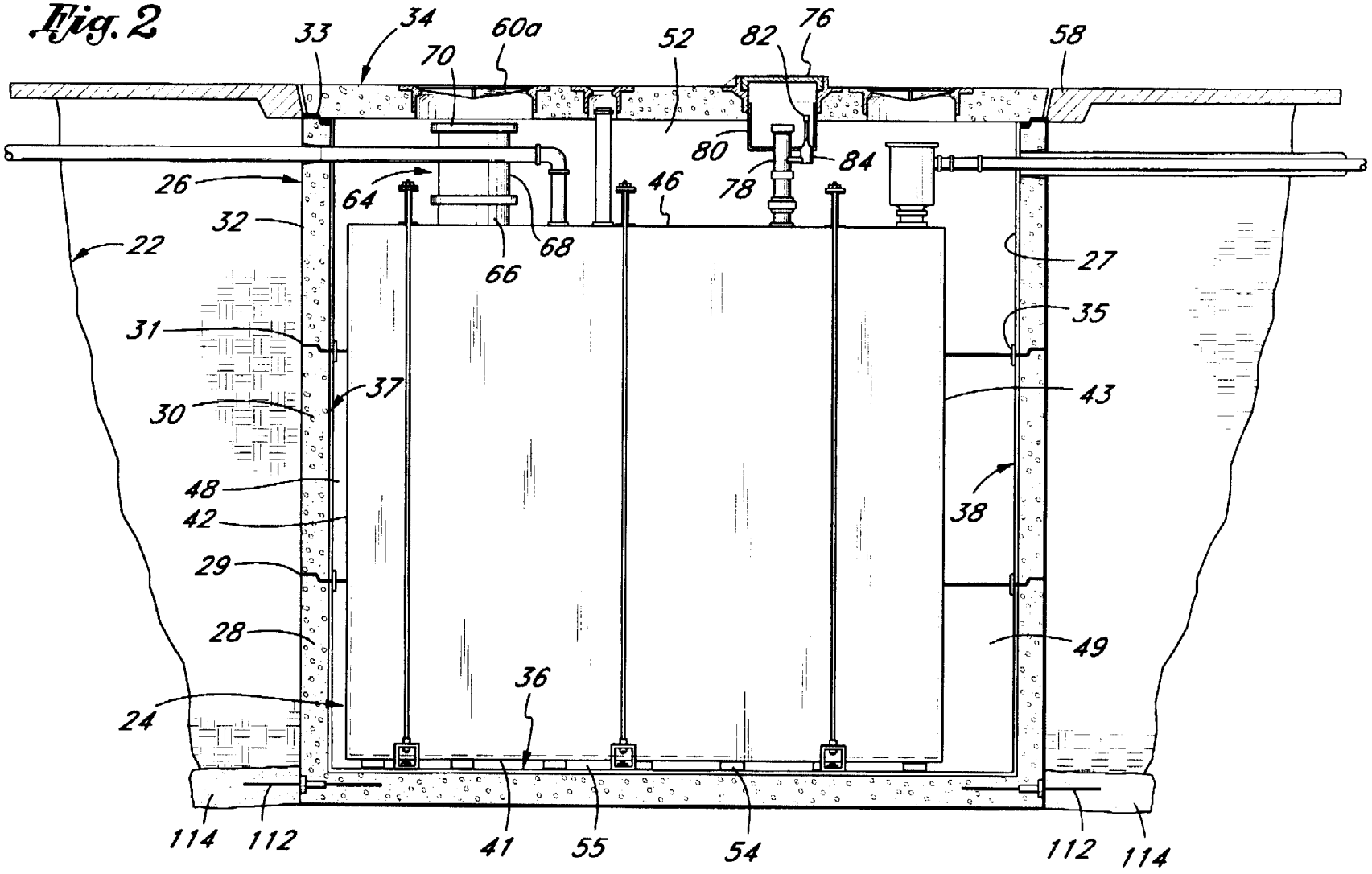
FIG. 2 is a sectional view of the system of FIG. 1 along line 2—2.
Figure 3:
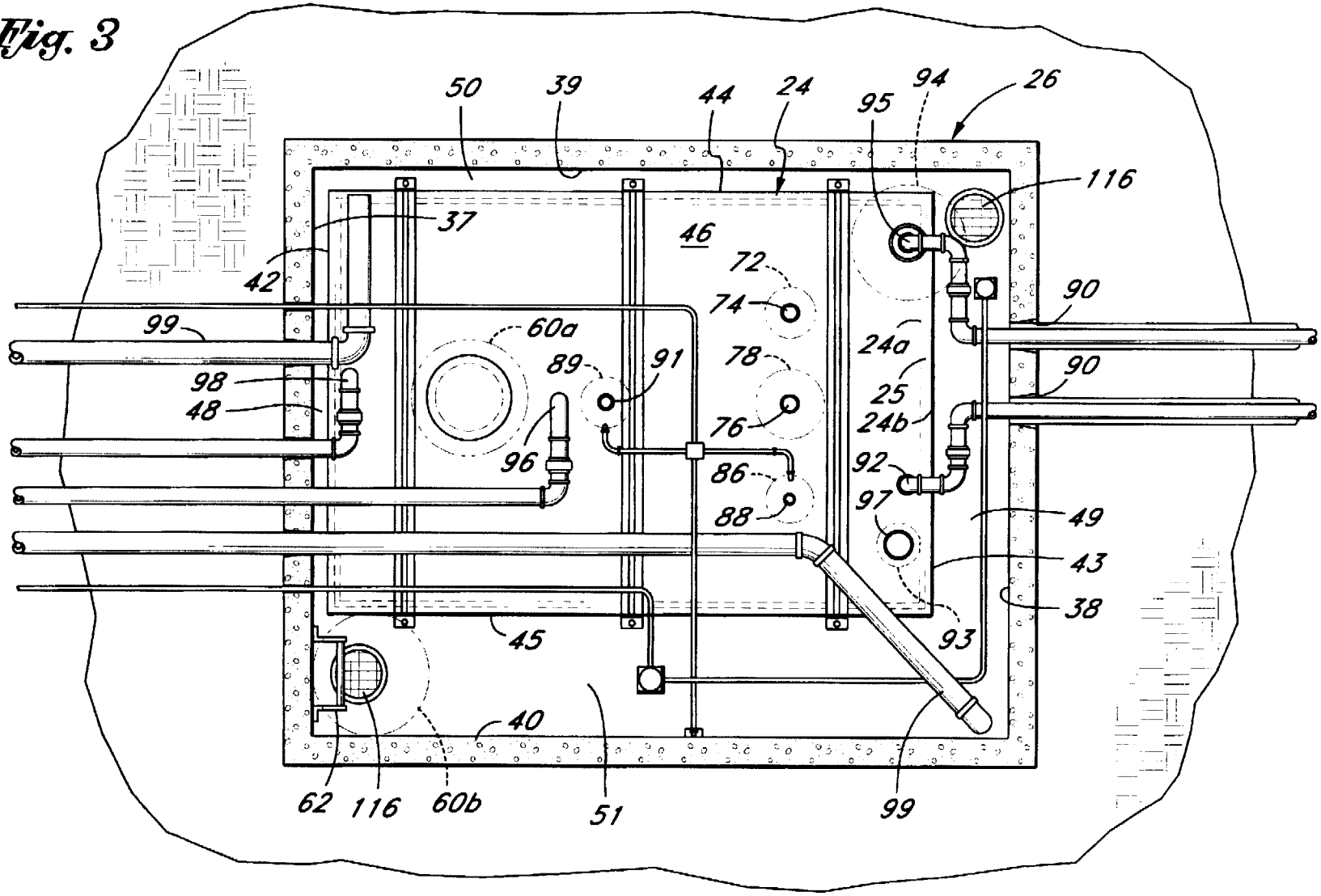
FIG. 3 is a sectional view of the system of FIG. 2 along line 3—3.

The components of a preferred underground vaulted storage system 20 of the present invention are shown in FIGS. 1–3. The vaulted underground storage system 20 is designed to be buried within an excavated hole 22, previously dug out, with the side walls sloped or shored up as required. The bottom floor of the excavated hole will be a uniformly graded subgrade providing a flat horizontal surface on which to place the vaulted tank system 20. Subsequent to the installation of the vaulted tank system 20, an amount of granular compacted backfill will be added between the vault and the excavated cavity 22 for support.

The underground vaulted tank storage system 20 generally comprises a toxic or other liquid storage vessel or tank 24 and an outer containment vault 26. The vault 26 is comprised of a bottom unit 28, one or more collar units, and a cover or lid 34. In the illustrated embodiment, the vault 26 includes a middle collar unit 30 and a top collar unit 32. The concrete vault 26 provides a box-shaped containment vessel for box-shaped tanks 24. In this description, both the tank 24 and vault 26 are box-shaped, or rectangular parallelepipeds. The vault 26 both retains the surrounding earth and provides an access space for visual inspection and/or repair of the tank.

Referring to FIGS. 2 and 3, when assembled the box-shaped containment vault 26 includes a bottom floor 36, a first upstanding wall 37, a second upstanding wall 38 opposite the first upstanding wall, a third upstanding wall 39, a fourth upstanding wall 40 opposite the third upstanding wall, and the aforementioned lid 34. The walls of the vault 26 are all rectangular, with their edges joined at right angles, thus forming the aforementioned parallelepiped shape. The storage tank 24 similarly comprises a bottom 41, a first upstanding side 42, a second upstanding side 43 opposite the first upstanding side, a third upstanding side 44, a fourth upstanding side 45 opposite the third upstanding side, and a top 46. The sides and corners of the tank 24 are likewise rectangular and right angled, respectively.

The storage tank 24 is placed within the vault 26 so that both the vault first wall 37 and tank first side 42, and the vault third wall 39 and the tank third side 44, are in close proximity. A larger clearance space exists between the vault second wall 38 and tank second side 43, and between the vault fourth wall 40 and tank fourth side 45. Additionally, a vertical clearance space 52 exists between the top 46 of the tank and the lower surface of the lid 34. A number of parallel spacers 54 are placed underneath the tank 24 to provide a bottom gap 55 between the tank and the bottom floor 36 of sufficient size to at least permit visual inspection of the portion of the bottom floor 36 beneath the tank 24, if not visual inspection of the tank bottom 41, itself. Desirably, the bottom gap 55 is between two and six inches and preferably the bottom gap 55 is approximately two inches. Advantageously, these spacers comprise lengths of channel iron or steel, welded to the tank bottom 41.

Together, bottom unit 28, middle collar unit 30, top collar unit 32 and lid 34 define an interior rectangular parallelepiped cavity within which the storage tank 24 is positioned. The tank rests on the bottom unit 28 and is positioned proximate one corner thereof. Advantageously, the size of the tank 24 is such that a vertical space exists between the top of the tank to the lid 34, as seen in FIG. 2. In addition, desirably the vault 26 and tank 24 cooperate to form an L-shaped access space adjacent the two tank sides 43, 45 which join opposite the corner of the vault that the tank is placed, as seen in FIG. 3.

As shown in FIG. 2, the bottom unit 28 and middle collar unit 30 meet at a stepped junction 29 providing a means for positioning the upper unit with respect to the lower unit. Likewise, the middle collar unit 30 and top collar unit 32 meet at a stepped junction 31, and the top collar unit 32 and lid 34 meet at a stepped junction 33. Preferably, the abutting surfaces at the junctions 29, 31 and 33 are sealed together to water seal the vault 26 and provide a secondary containment vessel. Desirably, an sealant such as RAM-NEK fills the cracks between the units at the junctions 29, 31 and 33. Additionally, a sheet of material such as, for example, Hypalon by Dupont may be epoxied across the interior joint of the junctions 29, 31 and 33, providing a sufficient seal for fuel containment.

Referring to FIGS. 2–3, the underground tank storage system 20 may be installed at a retail gasoline service station such that the lid 34 is flush with the surrounding pavement 58. The lid 34 provides a safe driving surface due to its sturdy steel-reinforced concrete construction. The lid 34 desirably includes one or more gasketed man-way covers 60 through which a service technician may obtain access to the interior of the vault 26.

In the preferred embodiment, the lid 34 includes a man-way cover **60*a* positioned above the top of the storage tank 24, and a second man-way cover 60*b* positioned proximate the corner of the vault 26 and over the clearance gap 51. A galvanized steel access ladder 62 descends from the second man-way cover 60*b* down the first vault side wall 37 to the bottom floor 36 of the vault. Desirably, the tank 24 includes a man-way 64 positioned directly below the first man-way cover 60***a* of the vault 26. Preferably, the tank man-way 64 consists of a lower flange piece 66 and an extension piece 68. The lower flange piece 64 -is preferably formed integrally with the tank 24 and has a height of six inches above the top 46 of the tank. The extension piece 68 has a height sufficient to substantially span the upper space 52 and includes flanges 70 on either end to couple with the lower flange piece 66 and the first man-way cover 60*a* in a manner well known in the art.

Desirably, the vertical clearance space 52 between the tank 24 and the lid 34 is sufficient to accommodate tank piping and connections to the tank top 46, advantageously avoiding such connections protruding from the sides of the tank which would necessitate an increase in vault size and risk draining the tank contents into the vault if a piping failure occurred. Desirably, the clearance space 52 has a height of between 12" and 36", and preferably the clearance space has a height of approximately 24".

Several other access ports provide communication with the interior of the vault 26 through the lid 34. A 12-inch diameter gasketed access cover 72 provides a port for a 4-inch diameter vapor return pipe extending up from a connection 74 in the tank top surface 46. A second 12-inch gasketed cover 86 provides access to a 2-inch diameter secondary container sensor pipe extending up from a connection 88 on the top of the tank. A third 12-inch diameter gasketed cover 89 provides access to a 4-inch diameter tank level pipe extending up from a connection 91 in the tank top surface 46. A fourth 12-inch diameter gasketed cover 93 provides access to a 6-inch diameter secondary containment emergency vent pipe extending up from a connection 97 in the top of the tank. A second 30-inch diameter gasketed man-way cover 94 provides access to a 6-inch diameter suction or supply pipe 95.

An approximately 18-inch diameter gasketed overfill containment cover 78 provides access to a 4-inch diameter fill tube, which extends down to a connection 76 on the tank 24 as a main filling conduit. An overfill containment well 80 depends from underneath the overfill cover 76, and an overfill nipple 82 opens into the well 80. The overfill nipple 82 joins to an elbow-configured pipe 84, which communicates with the interior of the fill tube 78. When the tank 24 is filled with fluid via the fill tube 78, the overfill nipple 82 alerts the technician that the maximum capacity has been reached prior to any fluid spilling from the tank man-way cover 60*a*. The open end of the nipple 82 is at a lower elevation than the cover 60*a* and thus the technician will observe fluid spilling from the nipple and into the containment well 80 signalling that the tank 24 is full and will shut off the fluid flow prior to the fluid level reaching the man-way cover.

Various other pipes extend upward from the tank 24 and bend to exit the vault via several aligned apertures 90 disposed approximately 10 inches below the lid 34 on the top collar 32 to thereafter communicate with external monitors, pipes, pumps or vents. Such pipes include a 2-inch diameter vapor return line 92, a 3-inch diameter primary tank vent pipe 96 and a 3-inch diameter secondary tank vent pipe 98. Several optional vault air supply pipes 99 extend through the collar 32 and into the inner space of the vault. The apertures 90 are initially cast into the collar 32 as dead-end knockouts which provide a partially formed aperture having a thin outer wall. After installation of the entire vault 26, the appropriate knockouts are punctured to form the apertures 90.

In the preferred embodiment, the upstanding walls 37, 38, 39 and 40 comprise slabs of steel reinforced precast concrete having a density of approximately 4,050 pounds per cubic yard. Desirably, the walls are constructed with one or more reinforcing steel mats (not shown), the steel complying with ASTM A615 grade 60 or ASTM A706 grade 70 and the bending and placement complying with ACI standards. The thickness of the walls may vary between 4 and 12 inches, and is desirably 8 inches thick. In one embodiment, the interior vault dimensions are 15 feet from the first wall 37 to the second wall 38, and 12 feet from the third wall 39 to the fourth wall 40. Consequently, the exterior width of the third or fourth walls 39, 40, is 16'4" and the exterior width of the first and second walls 37, 38 is 13'4".

Looking from above, as in FIG. 3, the storage tank 24 is situated within the vault 26 creating a first visual inspection gap 48 between the vault first wall 37 and tank first side 42 sufficiently wide to permit visual inspection of the first side 42 of the tank, and is desirably wide enough to meet existing visual inspection standards. A second visual inspection gap 50 is formed between the vault third wall 39 and tank third side 44, sufficiently wide to permit visual inspection of the third side 44 of the tank 24 and desirably wide enough to meet existing visual inspection standards. A first physical access gap 51 between the vault fourth wall 40 and tank fourth side 45 is sufficiently large to meet standard access requirements. The first physical access gap 51 permits physical access between the vault fourth wall 40 and the tank fourth side 45, and is desirably wide enough to enable an inspector to climb down the ladder 62 and check the fourth tank wall for leaks, as well as visually inspect along the first tank wall 37 via the first visual inspection gap 48. A second physical access gap 49 between the vault second wall 38 and tank second side 43 is sufficiently wide to permit visual inspection of the tank second wall and is desirably wide enough to meet existing access standards. The second physical access gap 49 allows an inspector to check the second tank wall for leaks, as well as visually inspect the third tank wall 44 via the second visual inspection gap 50.

Advantageously, the bottom 41 may be visually checked for leaks via the bottom gap 55 by an inspector located in the first physical access gap 51 or in the second visual inspection gap 50.

The position of the tank 24 within the vault 26 provides an important advantage, in that all four sides of the tank may be inspected visually without unduly enlarging the outer containment vault. Indeed, the provision of space along two sides for physical access, and space along the other two sides only for visual access, creates a highly efficient tank storage container. Desirably, the tank 24 is situated such that the first visual inspection gap 48 between the vault first wall 37 and tank first side 42 is between 2" and 10" wide, and preferably the gap 48 is 6" wide. Desirably, the second visual inspection gap 50 between the vault third wall 39 and tank third side 44 is between 2" and 10" wide, and preferably the gap 50 is 6" wide. The first physical access gap 49 between the vault second wall 38 and tank second side 43 is desirably between 12" and 30" wide. Preferably the first physical access gap 49 is between 18" and 24" and, more preferably, the gap is 18" wide. In addition, the second physical access gap 51 between the vault fourth wall 40 and tank fourth side 45 is desirably between 20" and 40" wide, and preferably is 30" wide.

An important aspect of the invention is the provision for a range of storage capacities of the tank 24 by virtue of varying vertical heights of the tank and vault 26. In this regard, the horizontal cross-sectional dimensions, may be standardized, lowering manufacturing costs, and the differences in tank capacities be accommodated by varying the vertical height of the tank 24 and vault 26. Desirably, the tank capacity is between 4,000 and 10,000 gallons, but the features of the present invention are suitable for storing tanks of other capacities.

With reference to FIGS. 1 and 2, the bottom unit 28 comprises a pan or cup-shaped rectangular member having vertical side wall portions comprising the bottom portion of the upstanding vault walls 37, 38, 39 and 40. The size of the bottom unit 28 is desirably the same for each of the standard tank storage capacities discussed below. The bottom unit 28 is preferably pre-fabricated from steel-reinforced precast concrete and has wall thickness of sufficient strength to withstand the loading of the exterior earth. The interior and exterior dimensions of the side wall portions of the bottom unit 28 correspond to those previously described for the side walls. Thus, the exterior dimensions of the bottom unit are between 5 and 15 feet on one side and between 10 and 22 feet on the opposite side, allowing the unit to be transported lengthwise on the back of a lightweight truck trailer rig, and obviating the need for the hiring of an escort truck. The bottom unit 28 comprises the largest section of the entire vault 26 and has a dry weight which generally enables the bottom unit to be transported without acquiring expensive shipping permits, as is commonly required in most states.

The bottom unit 28 has a bottom plate 36 with vertical side wall portions of steel-reinforced concrete. The interior side wall portions of the bottom unit 28 in all the following examples preferably extend 4 feet above the upper surface of the bottom 41. The bottom plate 36 and side wall portions are of a sufficient thickness to provide structural strength against exterior forces of the surrounding earth, and more desirably, comply with American Association of State Highway and Transportation Officials (AASHTO) HS-20 loading standards. Preferably, the bottom plate 36 is 9 inches thick and the side wall portions are 8 inches thick. The exterior dimensions of the bottom unit 28 are preferably 13'–4" on one side and 16'–4" on the opposite side. The bottom unit 28 preferably has a dry weight of approximately 47,000 lbs, or 23 tons.

Desirably, the storage tank 24 of the present invention is fabricated in a number of standard volumetric capacities utilizing some interchangeable parts. In this regard, the various sized tanks 24 all have the same horizontal dimensions but have different heights corresponding to the specific storage capacity. The tanks 24 are welded from sheet steel and thus the top 46 and bottom 41 sheets are the same size for all the tanks. In addition, the position of the piping connections on the top 46 of the tank are desirably identical each tank size. Furthermore, reinforcement ribs for the top 46 and bottom 41 are desirably interchangeable.

The preferred storage tank 24 desirably has a width along the first and second sides 42, 43 of between 100 and 120 inches and preferably 110 inches, and a length along the third and fourth sides 44, 45 desirably between 150 and 170 inches, and preferably 158 inches. The height of the tanks 24 will be described below for specific volumetric capacities.

Referring to FIG. 3, two 12-inch diameter round plastic catch-all sumps 116, approximately 3–4 inches deep, are desirably cast into the concrete bottom unit 28 at the corners joining the first and fourth vault walls 37, 40 and the second and third vault walls 38, 39. Any leakage from the tank 24 will advantageously drain to the sumps for easy removal.

The present invention reduces the total paving area required by acting as its own driving surface. The lid 34 is desirably designed in full compliance with the AASHTA existing standard specifications for highway bridges utilizing HS-20-44 loading with 30% impact factors. Because of the present invention's single-piece removable lid 34, hard-to-seal non-compressed leak-prone joints are eliminated and joint bumps are minimized in traffic areas.

The present vault is designed for 100% float-up resistance with ground water saturation to the finish grade elevation by optionally providing steel dowel bars 112 cast into the sides of the bottom unit for anchoring into the field ballast concrete slab extensions 114, which are cast abutting the undisturbed excavation cavity 22. Additionally, the internal steel tank 24 is anchored to the floor 36 to satisfy earthquake code requirements and resist internal tank float-up and associated piping damage should vault flooding occur.

10,000-Gallon Capacity Tank

In one embodiment, the tank 24 comprises a 10,000-gallon capacity Underwriter Laboratories (UL) listed tank with an optional UL-listed integral secondary containment tank. The outer walls of the vault 26 consist of the 4-foot tall side wall portions of the bottom unit 28, a 5-foot high square tubular middle collar 30 and a 5-foot tall square top collar 32, for a total height of 14 feet from the bottom 36 to the lid 34. The tank is approximately 11'8" tall, and thus a 20-inch long tank man-way extension piece 68 to reach from the lower flange piece 66 to the first vault man-way cover **60*a* is required. The total volume inside the vault 26 is approximately 2,520 $ft^3$, and the volumetric capacity of the tank is approximately 1,337 $ft^3$, resulting in a liquid storage space usage of approximately 53% within the vault. The total dry weight of the 10,000-gallon capacity storage vault 26** is approximately 128,384 pounds, or the equivalent weight of approximately 31.7 cubic yards of concrete.

8,000-Gallon Capacity Storage Tank

In another embodiment, the UL-listed tank 24 has a storage capacity of 8,000 fluid U.S. gallons. The 8,000-gallon storage capacity vault 26 comprises a bottom unit 28 with 4 foot tall side wall portions, as described before, a 5-foot tall square tubular middle collar 30, a 3-foot tall square tubular top collar 32, and the previously described lid 34. The approximate height of the tank above the bottom floor 36 is approximately 9'8", leaving a gap between the top 46 of the tank and the lid 34 of approximately 30 inches. Thus, the tank man-way extension piece 68 is approximately 24 inches long. The approximate volume inside the vault is 2,160 $ft^3$, and the volume of fluid corresponding to 8,000 gallons is 1,070 $ft^3$, resulting in a liquid storage space usage of approximately 50%. The total dry weight of the 8,000-gallon storage capacity vault 26 is approximately 117,000 pounds, or the equivalent weight of 28.9 cubic yards of concrete.

6,000-Gallon Storage Capacity Tank

Figure 4:
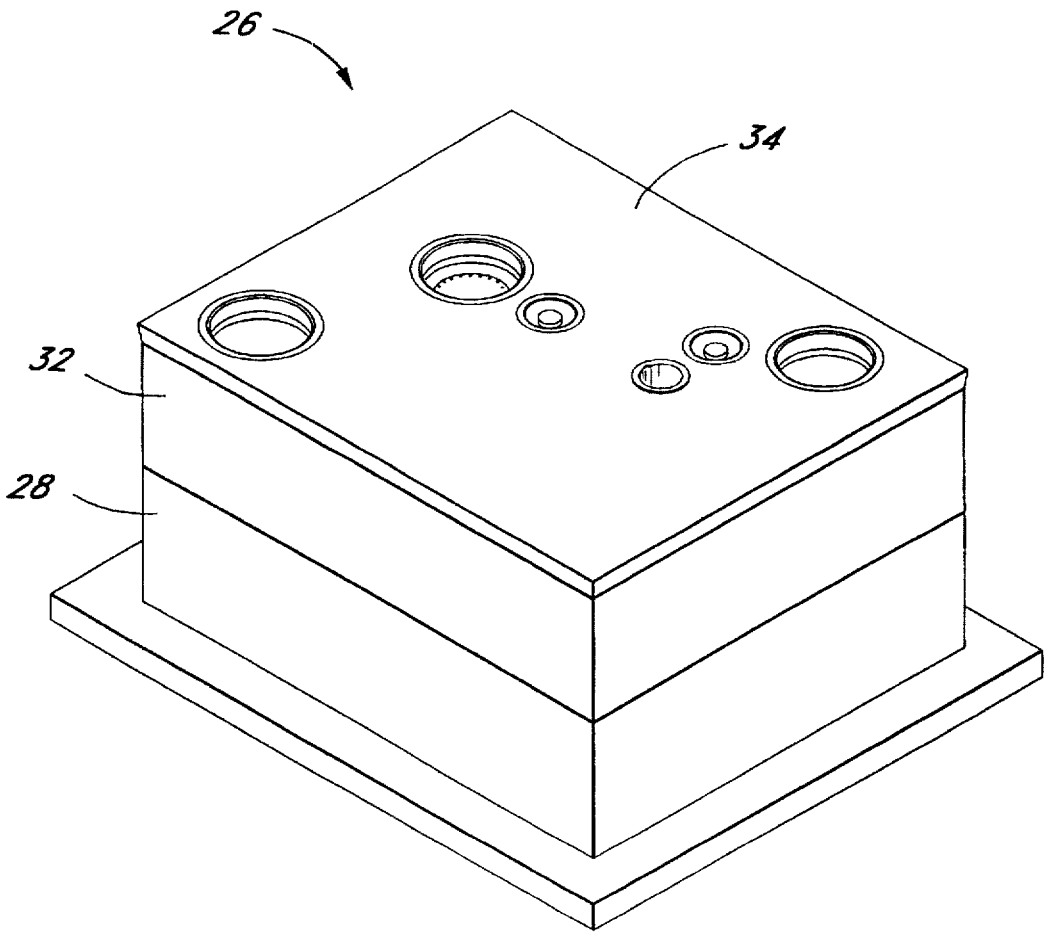
FIG. 4 is a partial cutaway perspective view of an underground storage tank and vault system of the present invention having a vault in three sections.

In a further embodiment, the UL-listed storage tank 24 comprises a 6,000-gallon storage capacity having a height of approximately 7'4" above the floor 36. The vault 26 comprises the aforementioned bottom unit 28 with 4-foot tall side wall portions and only one other section in addition to the lid 34, a 5-foot tall square tubular top collar 32. Such a vault 26 having only three sections is shown in FIG. 4. Thus, the space between the top 46 of the tank and lid 34 is approximately 20 inches, requiring a tank man-way extension piece 68 of 14 inches. The volume inside the vault is 1,620 $ft^3$ and the volume of fluid is 802 $ft^3$, resulting in a liquid storage space usage of approximately 50%. The total dry weight of the assembled vault 26 is approximately 100,000 pounds, or the equivalent weight of 24.7 cubic yards of concrete.

4,000-Gallon Storage Capacity Tank

In still a further embodiment, the storage capacity of the UL-listed tank 24 is approximately 4,000 gallons. The vault 26, of which FIG. 4 is representative, comprises a bottom unit 28 and a 3-foot tall square tubular top collar 32, for a total of 7 feet from the bottom 36 to the lid 34. The tank 24 has an approximate height of 5 feet, requiring an 18-inch long tank man-way extension piece 68. The volume inside the vault 26 is approximately 1,260 $ft^3$, while the volume of fluid is equivalent to 535 $ft^3$, resulting in a liquid storage space usage of approximately 42%. The total dry weight of the vault 26 is approximately 89,000 pounds, or the equivalent weight of 21.9 cubic yards of concrete.

All of the above-mentioned sizes of vaulted storage tanks may be constructed in a number of ways known for preventing ingress of ground water and egress of fuel or toxic liquid from the vault 26. For a 10,000 gallon capacity tank, the total weight of the tank is 7000 lbs, a relatively small proportion of the overall weight of the system. In the simplest embodiment, the primary tank comprises a ¼-inch thick welded steel container with no secondary tank and the vault 26 is water sealed at the joints to prevent ground water intrusion. In a second embodiment, still with only a primary tank 24, the vault 26 is sealed to prevent ground water intrusion and is also sealed on the interior side of the joints with a previously mentioned Hypalon or other material strip to provide 150% secondary fuel containment. The percentage for secondary fuel containment refers to the volume capacity of the secondary container with respect to the primary container volume. In a still further embodiment utilizing a single primary tank 24, the vault is sealed to prevent ground water intrusion and also provided with a castin poly liner to provide 150% secondary fuel containment.

As illustrated in FIG. 3, the tank 24 comprises a ¼-inch thick primary tank 24*a* with a 3/16-inch outer secondary tank 24*b* separated from the primary tank with a 3/16-inch gap 25. The vault 26 is sealed at the joints to prevent ground water intrusion and also provided with a cast-in polyliner 27 to provide 150% tertiary containment. The poly liner 27 is cast separately into the respective vault sections 28, 30 and 32 whereupon strips 35 of Hypalon or other material seal the joints between the liners. Alternatively, the tank 24 comprising a primary and secondary tank may be placed in a vault which is sealed to prevent ground water intrusion and strips of Hypalon or other material sealed across the joints to provide 150% tertiary containment.

Figure 5:
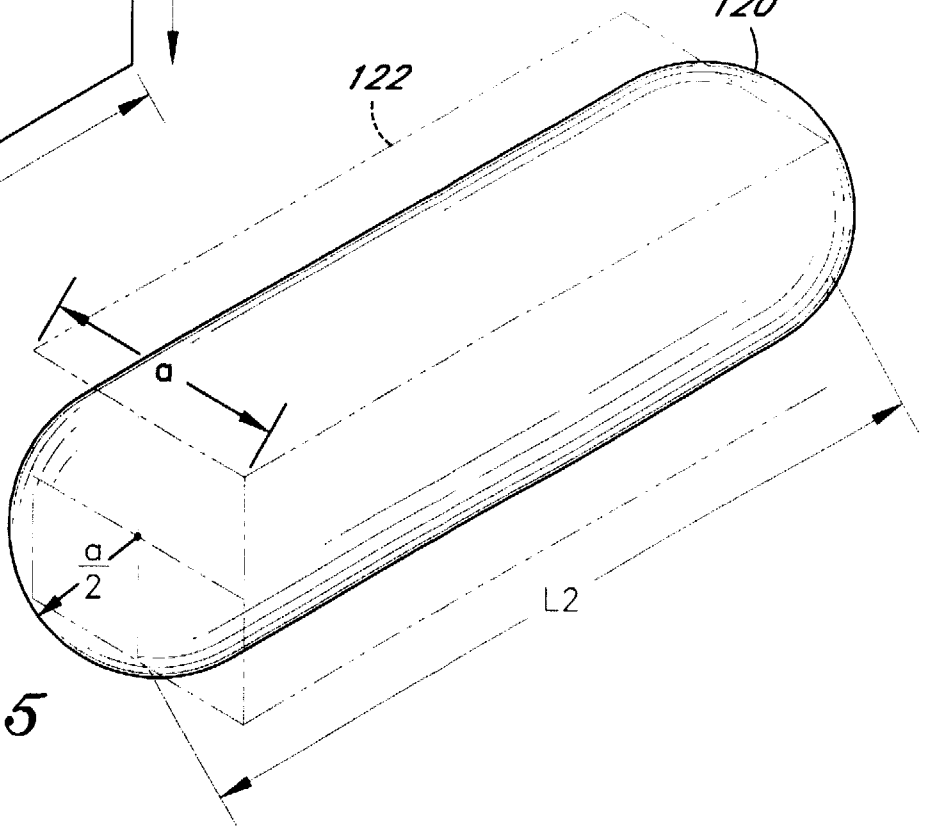
FIG. 5 is a schematic representation of rectangular storage tank.
Figure 6:
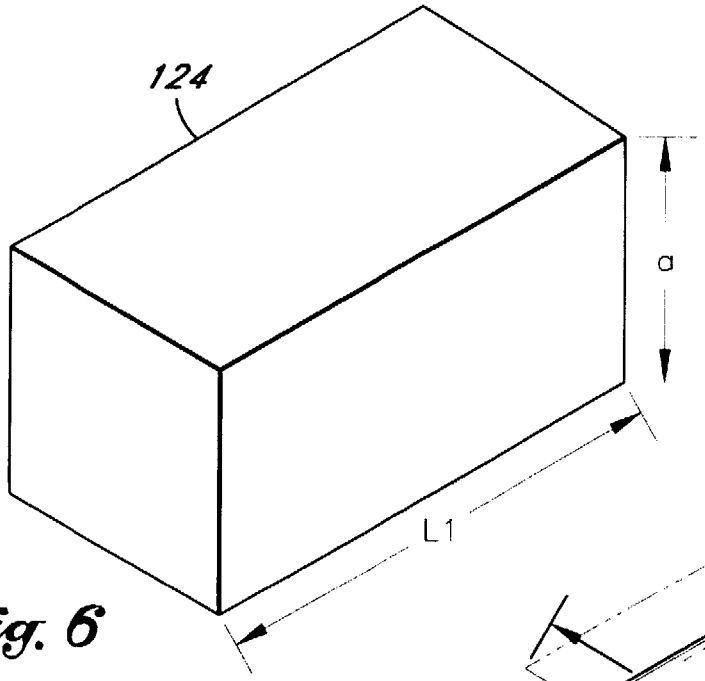
FIG. 6 is a schematic representation of a tubular storage tank of the prior art.

FIG. 5 illustrates a tubular volume 120 longitudinally aligned within a rectangular parallelepiped volume 122, shown in phantom. FIG. 6 shows a rectangular parallelepiped 124 having the same volume as the tube 120. The tubular volume 120 represents a typical shape of a liquid storage tank of the prior art and comprises a central tubular portion of diameter a, terminating in two hemispherical end caps of diameter "a". The total length of the tubular volume 120 is $L_2$. The rectangular volume 124 represents the preferred storage tank configuration of the present invention comprising a square cross section of sides of width a and with a length $L_1$. The length of the two volumes will be compared below for different storage capacities. Due to the fact that the cross-sectional projections are equal, the relative size of a containment vault for each of the two shaped tanks depends on their relative lengths.

EXAMPLE 1

If, for example, the storage capacity of the tanks 120, 124 is 10,000 gallons. This translates into a volume of approximately 1346 ft3. Assuming that the dimension "a" is 8 feet, the length $L_1$ will be 21.0 feet, and the length $L_2$ will be 29.4 feet. Now assume that a storage vault encloses the tanks and a total clearance of 24 inches at the ends and 36 inches at the horizontal sides is provided—thus meeting the minimum OSHA physical and visual access clearance requirements. No clearance is assumed at the top and bottom.

Assuming the vault has an 8 inch wall thickness, the outer dimensions of the vault around the tubular tank 120 are thus approximately 32.8 feet long by 12.3 feet across and 9.3 feet tall. The outer dimensions of the vault around the rectangular tank 124 are thus 24.3 feet long by 12.3 feet across and 9.3 feet tall, or at least 34% shorter than the vault for the tubular tank having the identical capacity. Assuming the concrete has a dry weight density of 100 lbs per ft3, the volume of concrete necessary to vault the tubular tank is approximately 1004 ft3, and the total dry weight thus is 104,000 lbs. The volume of concrete necessary to store the rectangular tank 124 is approximately 777 $ft^3$ and the total weight is 77,700 lbs, or 22,700 pounds less than the vault for the tubular tank having the identical capacity. Not only does the design of the present invention save on concrete and transportation costs, however, dues to its smaller size, it requires less dirt to be excavated. Assuming a cavity to receive the vault is 1 foot wider an all sides and the same depth, a hole for the rectangular tank vault requires 4950 $ft^3$ of dirt to be excavated, as opposed to 3740 $ft^3$ of dirt as required by the tubular design. Assuming an average dirt weight of 100 $lbs/ft^3$, this is 121,000 lbs. less dirt to be excavated.

EXAMPLE 2

If the storage capacity of the tanks 120, 124 is 8,000 gallons, or a storage volume of approximately 1073 ft3, the length $L_1$ will be 16.8 feet, and the length $L_2$ will be 24.0 feet. A storage vault enclosing the tanks having a total clearance of 24 inches at the ends and 36 inches at the horizontal sides and no clearance at the top and bottom is provided.

Assuming the vault has an 8 inch wall thickness, the outer dimensions of the vault around the tubular tank 120 are thus 27.3 feet long by 12.3 feet across and 9.3 feet tall. The outer dimensions of the vault around the rectangular tank 124 are thus 20.1 feet long by 12.3 feet across and 9.3 feet tall, or over 35% shorter than the vault for the tubular tank having the identical capacity. Assuming the concrete has a dry weight density of 100 lbs per ft3, the volume of concrete necessary to vault the tubular tank is approximately 858 ft3, and the total dry weight thus is 85,800 lbs. The volume of concrete necessary to store the rectangular tank 124 is approximately 663 $ft^3$ and the total weight is 66,300 lbs, or 19,500 pounds less than the vault for the tubular tank having the identical capacity. Assuming a cavity to receive the vault is 1 foot wider an all sides and the same depth, a hole for the rectangular tank vault requires 3140 $ft^3$ of dirt to be excavated, as opposed to 4270 $ft^3$ of dirt as required by the tubular design. Assuming an average dirt weight of 100 $lbs/ft^3$, this is 113,000 lbs. less dirt to be excavated.

The resulting amounts of concrete necessary to enclose both a tubular tank 120 and rectangular tank 124 are shown in tabular form below for the preceding examples.

| Tank Capacity Equals 10,000 Gallons | | | | |
|---|---|---|---|---|
| | Tank Volume, $ft^3$ | Tank Length, ft | Vault Length, ft | Vault Weight, lbs |
| System of the Preferred Embodiment | 1346 | 21.0 | 24.3 | 77700 |
| System using tubular tank 120 | 1346 | 29.4 | 32.8 | 100400 |

| Tank Capacity Equals 8,000 Gallons | | | | |
|---|---|---|---|---|
| | Tank Volume, $ft^3$ | Tank Length, ft | Vault Length, ft | Vault Weight, lbs |
| System of the Preferred Embodiment | 1073 | 16.8 | 20.1 | 66300 |
| System using tubular tank 120 | 1073 | 24.0 | 27.3 | 85800 |

In two further examples, the storage capacity of the tanks are 4,000 and 6,000 gallons. The resulting amounts of concrete necessary to enclose both a tubular tank 120 and rectangular tank 124 are shown below in tabular form.

EXAMPLE 3

| Tank Capacity Equals 4,000 Gallons | | | | |
|---|---|---|---|---|
| | Tank Volume, $ft^3$ | Tank Length, ft | Vault Length, ft | Vault Weight, lbs |
| System of the Preferred Embodiment | 546 | 8.5 | 11.8 | 43800 |
| System using tubular tank 120 | 546 | 13.5 | 16.8 | 57400 |

EXAMPLE 4

| Tank Capacity Equals 6,000 Gallons | | | | |
|---|---|---|---|---|
| | Tank Volume, $ft^3$ | Tank Length, ft | Vault Length, ft | Vault Weight, lbs |
| System of the Preferred Embodiment | 819 | 12.8 | 16.1 | 55460 |
| System using tubular tank 120 | 819 | 19.0 | 22.3 | 72300 |

It is apparent that as the storage capacity increases, the amount of concrete needed to enclose the rectangular volume 124 provides a great savings over the amount necessary to enclose the tubular volume 120. This demonstration, although somewhat abstract, illustrates the efficient use of fluid storage capacity of the rectangular shape of the present invention in underground storage applications. In every example, the projected size of the rectangular volume 124 is smaller than the tubular volume 120, but the volumetric storage capacity is the same. In short, in comparison to standard vaulted tubular tank systems, the present vaulted storage system uses less concrete and less land area, has a lower transported weight and permits the use of a smaller installation crane.

In addition, as noted previously, the minimum volume of earth required to be excavated is smaller for the rectangular volume 124. The minimum volume of earth required to be excavated for each comprises at least the outer volume of the concrete storage vault and, in practice, at least one foot around the sides of the vault to a predetermined depth equal to the height of the vault if the top is to be flush with the surrounding grade. Thus, the reduced length of the vault needed to store the rectangular tank 124 produces a substantial reduction in excavation size, time to excavate and associated cost.

To illustrate an example using existing vaults, the following table compares a preferred form of the storage system 20 of the present invention with a typical storage system manufactured by SUREVAULT. Both tanks store slightly more than 10,000 gallons, the example of the present invention having a capacity of 10,065 gallons and the SUREVAULT tank a capacity of 10,500 gallons. Both vaults are fabricated from steel-reinforced pre-cast concrete. The SUREVAULT design has external dimensions of 31'-8" long by 12'-0" wide by 5"2.5" tall, while the preferred embodiment has external dimensions of 16'-4" long by 13'-4" wide by 15'-6" tall.

| 10,000 Gallon Storage Tank Vault | | | |
|---|---|---|---|
| | Largest Dimension (Length) | Largest Vault Section Approximate Weight | Total Vault Approximate Weight |
| SUREVAULT | 31'-8" | 79,300 lbs | 175,660 lbs |
| Preferred Embodiment | 16'-4" | 47,200 lbs | 128,600 lbs |
| Absolute Savings | 15'-4" | 32,100 lbs | 47,060 lbs |
| Percent Savings | 48% | 40% | 26% |

Thus, the vault of the preferred embodiment of the underground storage system is 47,060 pounds lighter than the vault of the SUREVAULT system. This represents not only a substantial savings in concrete costs to manufacture the unit, but because the largest section of the vault weighs only 47,200 pounds (32,100 pounds less than the largest SUREVAULT vault section), smaller, less expensive cranes can be used to install the system and the need for transportation permits can be minimized. Notably, the largest dimension of the vault of the preferred embodiment is 15'4" shorter than that of the SUREVAULT design. This is critical as it allows the system to be installed in locations where a comparable capacity SUREVAULT or other prior art system could not, either due to restrictive easements or other considerations.

Figure 7:
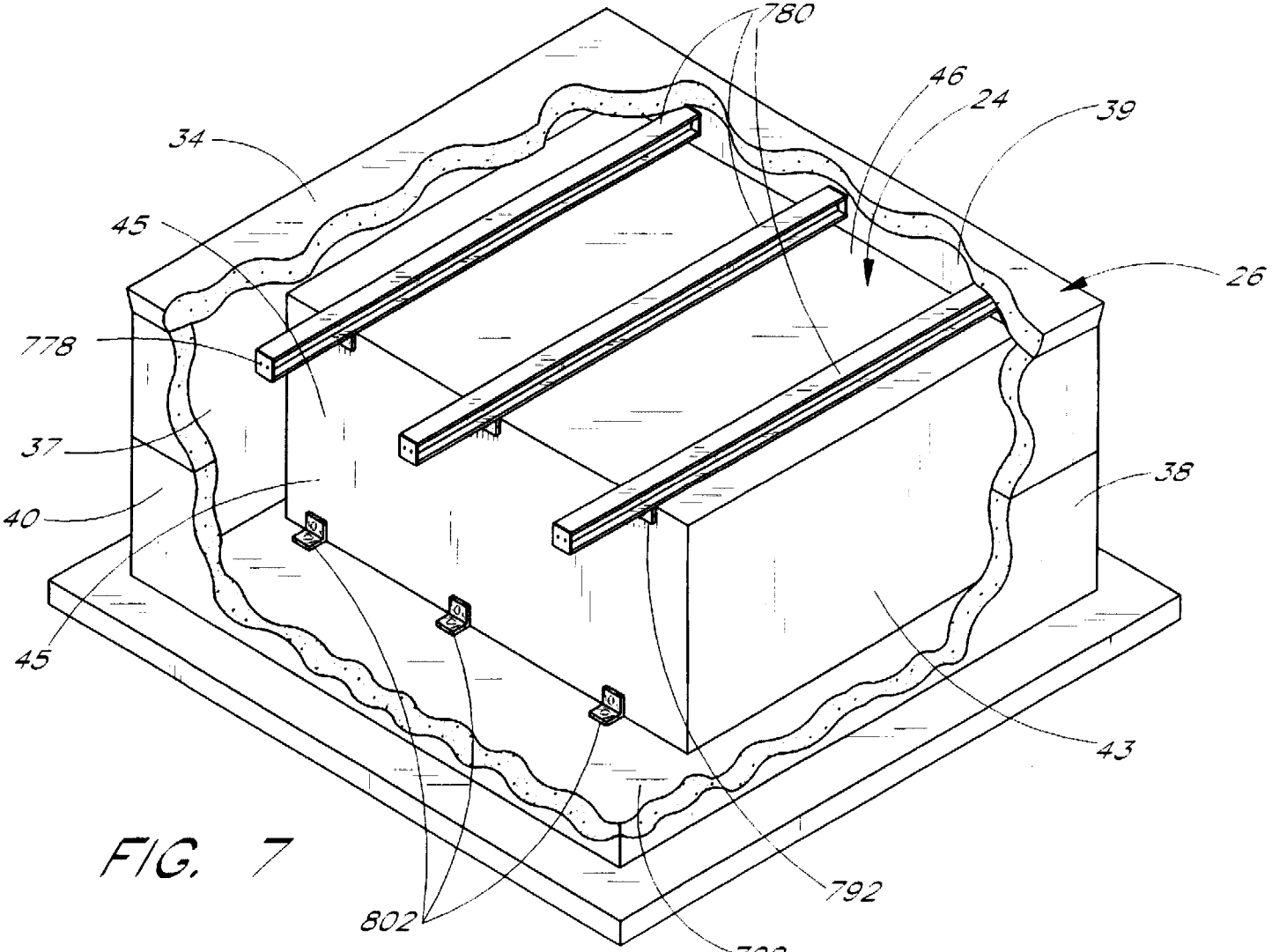
FIG. 7 is a partially cut-away perspective view of a preferred embodiment of a storage system in accordance with the present invention.
Figure 8:
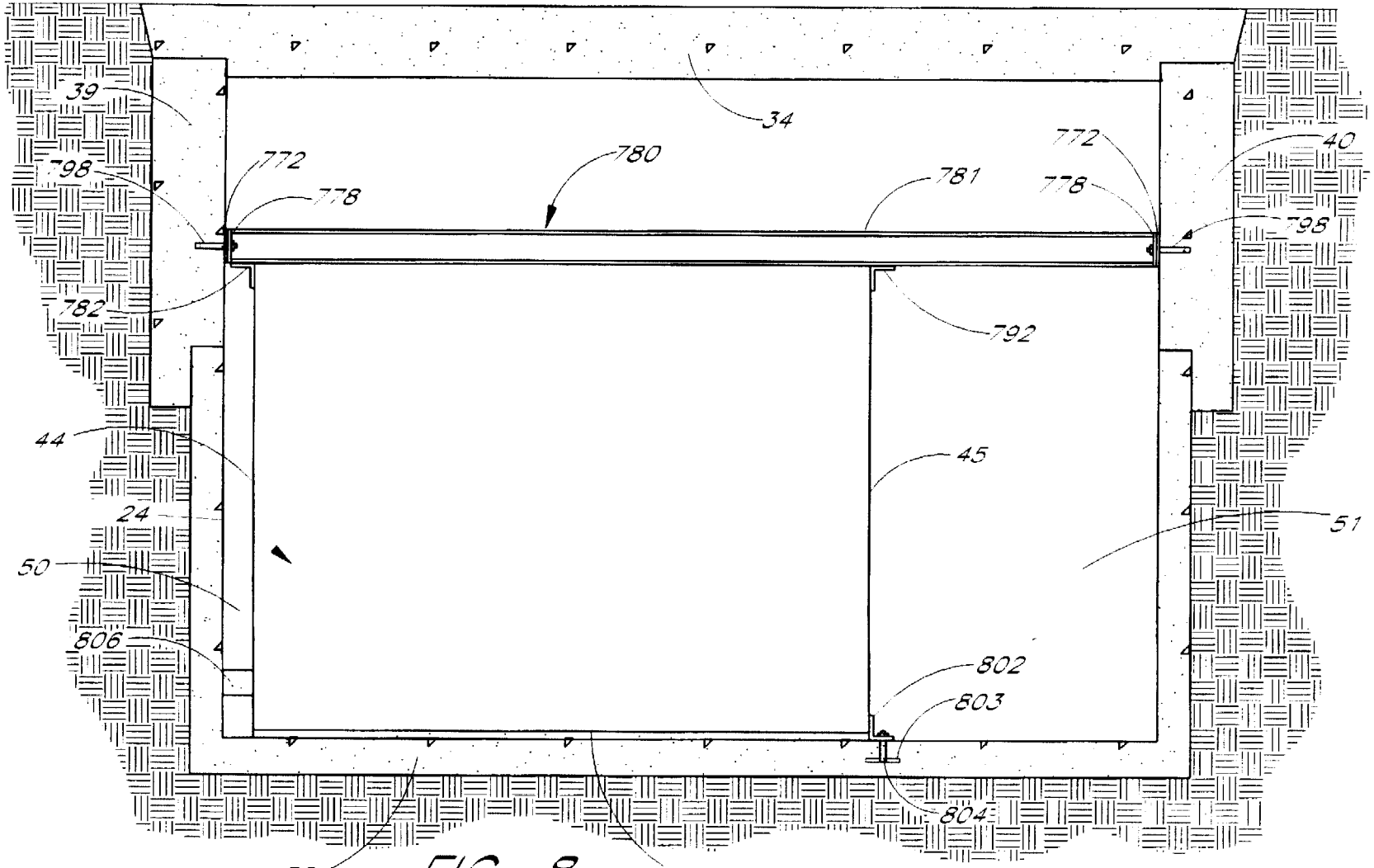
FIG. 8 is a vertical cross-sectional view of the storage system shown in FIG. 7.

FIGS. 7 and 8 illustrate a storage system comprising an outer containment vault 26, a storage tank or vessel 24 and a plurality of prefabricated structural members 780 positioned within the vault, above and across the storage tank 24. In addition, a plurality of bottom restraints 802 are attached to the bottom of the vault 26 and positioned close to the storage tank 24.

Preferably, except as specifically noted, the outer containment vault 26 and the storage tank 24 are constructed in the manner described and depicted in connection with the embodiment shown in FIGS. 1–6. Thus, although a storage tank of any shape or size may be positioned within the outer containment vault 26, in a preferred embodiment, a box-shaped storage tank 24 is installed within a box-shaped vault 26. Furthermore, desirably the storage tank 24 is positioned within the vault 26 in the manner described in connection with the embodiment shown in FIGS. 1–6.

One or more structural members 780, each comprising a steel I-beam 781, two rectangular steel plates 778, a first depending restraint 782, and a second depending restraint 792, are positioned within the vault 26. The structural member is generally located within the vertical clearance space 52 above the tank 24. Preferably, the relatively large planar lower surface of the beam rests atop or is in frictional contact with the entire width of the upper surface 46 of the tank. The steel beam 781 of the structural member is parallel to the first and second upstanding walls 37, 38 of the vault. One end of the structural member is connected to the third vault wall 39 and the opposite end is connected to the fourth vault wall 40.

Advantageously, the structural member is prefabricated before the beam is positioned within the vault 26. The first and second depending restraints 782, 792 are welded or otherwise attached to the underside of the steel I-beam 781. The depending restraints 782, 792 are desirably spaced apart along the beam 781 a distance not less than the width of the storage tank 24. Specifically, the depending restraints 782, 792 are desirably spaced wide enough apart along the beam 781 so that, when the structural member 780 is installed above the storage tank 24, the storage tank 24 is positioned between the depending restraints 782, 792. In a preferred embodiment, the depending restraints 782, 792 are spaced apart a distance just slightly greater than the width of the storage tank 24 so as to form a slip-fit therewith.

Figure 9:
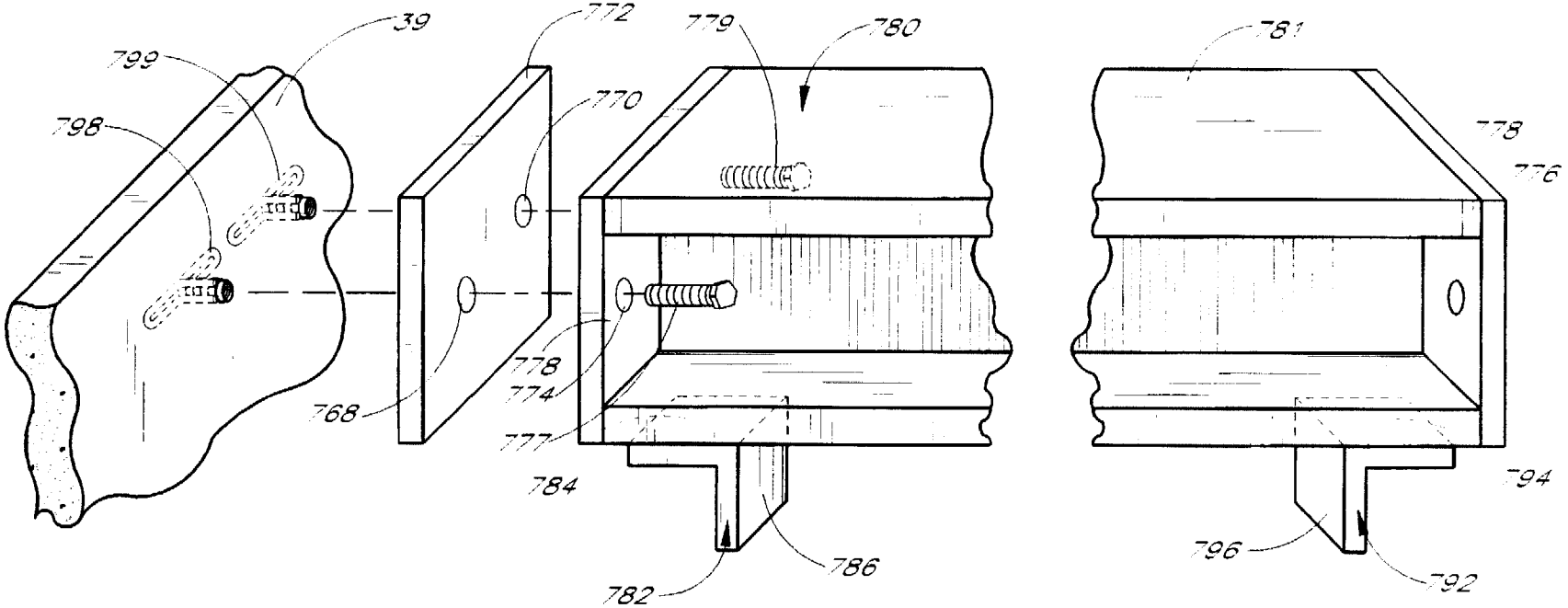
FIG. 9 is an exploded perspective view of the structural member used in the storage system of FIG. 7.

Advantageously, a surface of each of the depending restraints is shaped to complement or is generally form-fitted to a portion of the outer surface of the storage tank. As illustrated in FIG. 9, each depending restraint 782, 792 comprises an L-shaped steel plate with a first planar surface 784, 794 and a second planar surface 786, 796. The first planar surface 784, 794 extends parallel to and welded or otherwise attached to the underside of the beam 781. The second planar surface 786, 796 depends generally perpendicularly from the underside of the beam 781, parallel to the third 44 and fourth sides 45 of the storage tank 24. Because the size and shape of the depending restraints 782, 792 vary according to the size and shape of the storage tank 24, in other embodiments of the present invention, the depending restraints 782, 792 may be sized and shaped in a variety of different ways.

The structural member 780 further includes two rectangular steel plates 778 welded or otherwise attached to the beam 781. One steel plate 778 is welded to one end of the beam 781 and a second steel plate is welded to the opposite end of the beam 781. The height and width of each steel plate 778 is generally the same as the height and width of the beam 781. In addition, each beam plate 778 defines two openings 774, 776, each of which is sized and shaped to receive a fastener, such as a bolt.

Desirably, the total length of the structural member 780, which includes the steel plates 778 welded to the beam 781, is slightly shorter than the width of the vault 26. A first shim plate 772 is positioned between one end of the structural member 780 and the third vault wall 39. A second shim plate 772 is positioned between the opposite end of the structural member 780 and the fourth vault wall 40. Each shim plate 772 advantageously comprises a sheet of metal of a thickness corresponding to the distance between the ends of the structural member 780 and the opposing vault walls 39, 40. Further, the shim plate 772 defines two holes 768, 770. When the shim plate 772 is positioned between the structural member 780 and the vault wall, the holes 768, 770 of the shim plate are aligned with the openings 774, 776 on the steel plate 778 of the structural member.

A plurality of connector inserts 798, 799 are pre-embedded in the third vault wall 39 and the fourth vault wall 40. In a preferred embodiment, F-62 flared thin ferrule inserts, manufactured by Dayton Superior, of Miamisburg, Ohio, are embedded within the opposing vault walls 39, 40 prior to assembly of the vault. The structural member 780 is thus attached to the third and fourth vault walls 39, 40 by fasteners or bolts 777, 779 extending through the openings 774, 776 of the steel plate, through the holes 768, 770 on the shim plate and into the connector inserts 798, 799 at either end of the beam 781.

A plurality of bottom restraints 802 are attached to the bottom floor 36 of the vault. The bottom restraints 802 are positioned along and in close proximity to the fourth side 45 of the storage tank. Like the number of structural members 780, the number of bottom restraints 802 will vary depending on the seismic zone and size of the storage tank 24.

In a preferred embodiment, the bottom restraint 802 comprises an L-shaped steel plate with two sections. One section is parallel to the bottom floor 36 of the vault and defines an opening. The opening is aligned with a connector insert 803 embedded in the vault bottom unit 28. A connector or bolt 804 extending through the opening and into the connector insert 803 attaches the bottom restraint 802 to the bottom floor 36 of the vault. The second section of the bottom restraint 802 defines an extending surface sized and shaped to complement the outer surface of a portion of the storage tank 24. In a preferred embodiment, the extending surface of the bottom restraint 802 is parallel to and attached to the fourth side 45 of the storage tank 24, for example, by welding.

In an alternative embodiment, two sets of bottom restraints 802 are attached to the bottom floor 36 of the vault and positioned along opposing sides of the storage tank 24. One set of bottom restraints 802 is positioned along the third side 44 of the tank and a second set of bottom restraints 802 is positioned along the fourth side 45 of the tank. The bottom restraints 802 are bolted into connector inserts 803 embedded within the bottom floor 36 of the vault. Shim plates 772 are inserted, as needed, between the bottom restraints 802 and the storage tank 24 to securely wedge the tank 24 between the two sets of bottom restraints 802. Since the storage tank 24 is wedged in place by the two sets of bottom restraints, it is not necessary to attach the bottom restraints 802 to the storage tank 24.

Advantageously, the set of bottom restraints 802 located along the third side 44 of the tank is attached to the vault bottom 36 before the storage tank 24 is positioned within the vault 26. The bottom restraints 802 along the fourth side 45 of the storage tank, however, may be attached to the vault bottom 36 either before or after the tank 24 is positioned within the vault 26.

In another embodiment, a set of bottom restraints 802 is positioned, but not structurally connected, along the fourth side 45 of the storage tank. Spacers 806, such as a bar or a plurality of bricks, made of concrete or steel, are positioned between the third side 44 of the storage tank and the third wall 39 of the vault. To prevent the spacers 806 from being dislodged during seismic activity, the spacers 806 may be attached, such as with an epoxy glue, to the third wall 39 of the vault prior to installing the storage tank 24 within the vault 26. Advantageously, the bottom restraints 802 along the fourth side of the tank prevent horizontal movement in one direction. The spacers 806 prevent movement in the opposite direction.

When constructing the storage system, the structural members 780 are merely lowered into the vault 26 and positioned across the storage tank 24 such that the openings 774, 776 on the steel plates of the structural members 780 are aligned with the connector inserts 798, 799 embedded in the third and fourth walls 39, 40, of the vault. Since the length of the structural member 780 is slightly shorter than the width of the vault 26, the structural member is not in frictional contact with the vault walls as the structural member is being lowered into the vault. Shim plates 772 of the desired thickness are inserted between the structural member 780 and the vault walls to provide a secure fit between the vault 26 and the structural member 780. Bolts 777, 779 are then inserted through the steel plate 778 and the shim plate 772, and into the connector inserts 798, 799 to attach the structural member 780 to the vault wall.

The plurality of bottom restraints 802 may be attached to the bottom of the vault either before or after the tank 24 is positioned within the vault 26. If the bottom restraints 802 are attached to the bottom of the vault before the storage tank 24 is positioned within the vault 26, the bottom restraints 802 serve as a guide when positioning the tank 24 within the vault 26. One the other hand, the bottom restraints 802 may be advantageously attached to the storage tank 24 during manufacture of the tank 24. Thus, a mistaken attempt of welding a bottom restraint 802 to a tank 24 that has already been filled with flammable liquid will be avoided.

Although the storage tank 24 may be situated within the vault 26 in any configuration, the present invention is particularly advantageous with storage systems in which the storage tank 24 is positioned within the vault 26 in such a way that not all sides of the tank is physically accessible. The depending restraints 782, 792 of the structural member advantageously restrain the tank 24 in both directions, even though the depending restraints 782, 792 are not fixed to the storage tank 24. Therefore, it is not necessary to access the spaces between the third side 44 of the tank and the third wall 39 of the vault and the fourth side 45 of the tank and the fourth wall 40.

Advantageously, the first depending restraint 782 restrains the storage tank 24 horizontally in one direction and the second depending restraint 792 horizontally restrains the storage tank 24 in the opposite direction. Because the depending restraints 782, 792 are in close proximity to the storage tank 24, when the tank 24 moves slightly in either direction, the tank 24 contacts one of the restraints 782, 792 and further movement is hindered. In a preferred embodiment, the tank 24 is wedged between the depending restraints 782, 792 so that even the slightest horizontal movement of the storage tank 24 is restricted.

In addition, in a preferred embodiment, the lower surface of the beam contacts the upper surface of the tank to form a large frictional surface between the structural member 780 and the tank 24. Thus, not only does the beam restrain the tank in the vertical direction, it also restrains the tank in the horizontal direction by its frictional contact with the upper tank surface.

During seismic activity, the structural member 780 transfers horizontal seismic forces from the top and sides of the tank 24 to the vault walls. In addition, the structural member 780 transfers uplift forces due to potential vault flooding to the connections of the structural member at the vault wall.

Advantageously, the modular design of the structural members 780 facilitates ease of compliance with the different regulations in each seismic zone. While the storage tank 24 and the vault 26 are uniform components that may be used interchangeably in any seismic zone, the number of structural members 780 placed above the tank 24 is variable according to the seismic zone. Therefore, by merely adjusting the number and size of the structural members 780 within the storage system, the requirements within the particular seismic zone are satisfied.

Although this invention has been described in terms of certain preferred embodiments, other embodiments that are apparent to those of ordinary skill in the art are also within the scope of this invention. Accordingly, the scope of the invention is intended to be defined only by the claims which follow.

What is claimed is:

1. An underground storage system, comprising:

a vault, comprising:

a bottom; and a pair of opposing upstanding walls;

a pre-fabricated storage vessel positioned within said vault; and a structural member positioned within said vault, above and across said storage vessel, said structural member comprising:

a beam;

a first depending restraint attached to said beam; and a second depending restraint attached to said beam, such that said first depending restraint and said second depending restraint are spaced apart along said beam a distance not less than the width of said storage vessel to wedge said storage vessel between said first restraint and said second restraint, wherein said first restraint and said second restraint are fixed only to said beam and are not fixed to said storage vessel or to said vault, said first restraint restricting horizontal movement of said storage vessel relative to said vault in one direction and said second restraint restricting horizontal movement of said storage vessel in the opposite direction.

2. The storage system of claim 1, wherein said first depending restraint and said second depending restraint are spaced apart along said beam a distance just slightly greater than the width of said storage vessel so that said depending restraints form a slip fit with said storage vessel.

3. The storage system of claim 1, wherein said first depending restraint and said second depending restraint each comprise a fitted surface shaped to complement a portion of the outer surface of said storage vessel.

4. The storage system of claim 1, further comprising a plurality of connector inserts embedded within said pair of opposing walls of said vault, wherein each end of said structural member is aligned with one of said connector inserts in each of said opposing walls.

5. The storage system of claim 1, further comprising a bottom restraint attached to said bottom of said vault to restrict the movement of said storage vessel relative to said vault.

6. The storage system of claim 5, wherein said bottom restraint is structurally connected to said storage vessel.

7. The storage system of claim 5, wherein said bottom restraint comprises an extending surface sized and shaped to complement the outer surface of a portion of said storage vessel.

8. The storage system of claim 5, wherein said bottom restraint comprises a planar bottom surface parallel to and attached to said bottom of said vault.

9. The storage system of claim 5, further comprising a first set of bottom restraints positioned along one side of said storage vessel to restrict horizontal movement of said storage vessel in one direction, and a second set of bottom restraints positioned along an opposing side of said storage vessel to restrict horizontal movement of said storage vessel in the opposite direction.

10. An underground storage system, comprising:

a vault, comprising:

a bottom; and a pair of opposing upstanding walls;

a pre-fabricated storage vessel positioned within said vault;

a structural member positioned within said vault, above and across said storage vessel, said structural member comprising:

a beam;

a first depending restraint attached to said beam; and a second depending restraint attached to said beam, such that said first depending restraint and said second depending restraint are spaced apart along said beam a distance not less than the width of said storage vessel to wedge said storage vessel between said first restraint and said second restraint, wherein said first restraint and said second restraint are not fixed to said storage vessel, said first restraint restricting horizontal movement of said storage vessel relative to said vault in one direction and said second restraint restricting horizontal movement of said storage vessel in the opposite direction;

a bottom restraint attached to said bottom of said vault to restrict the movement of said storage vessel relative to said vault; and a spacer wedged between said storage vessel and one of said vault walls to restrain horizontal movement of the storage vessel in one direction.

11. An underground storage system, comprising:

a vault, comprising:

a bottom; and a pair of opposing upstanding walls;

a pre-fabricated storage vessel positioned within said vault; and a structural member positioned within said vault, above and across said storage vessel, said structural member comprising:

a beam;

a first depending restraint attached to said beam; and a second depending restraint attached to said beam, such that said first depending restraint and said second depending restraint are spaced apart along said beam a distance not less than the width of said storage vessel to wedge said storage vessel between said first restraint and said second restraint, wherein said first restraint and said second restraint are not fixed to said storage vessel, said first restraint restricting horizontal movement of said storage vessel relative to said vault in one direction and said second restraint restricting horizontal movement of said storage vessel in the opposite direction, wherein said beam comprises a lower surface and said storage vessel comprises an upper surface, said lower surface of said beam in frictional contact with said upper surface of said storage vessel.

12. A method of constructing an underground storage system, comprising the steps of:

excavating a hole in the ground of sufficient size to contain a vault of the desired capacity;

positioning within said hole a vault, comprising:

a bottom defining an interior bottom surface; and a pair of opposing upstanding walls;

positioning a pre-fabricated storage vessel within said vault;

attaching a bottom restraint to said bottom surface of said vault;

positioning a structural member above and across said storage vessel, said structural member comprising:

a beam;

a first depending restraint having a height less than the height of said storage vessel, said first restraint positioned to one side of said beam; and a second depending restraint having a height less than the height of said storage vessel, said second restraint positioned to an opposing side of said beam, wherein said first depending restraint and said second depending restraint are spaced apart along the length of said beam a distance not less than the width of said storage vessel to sandwich said storage vessel between said first restraint and said second restraint; and attaching said structural member to said pair of walls of said vault.

13. The method of claim 12, wherein the step of attaching said bottom restraint to said bottom surface of said vault is performed before said positioning of said storage vessel within said vault.

14. A method of constructing an underground storage system, comprising the steps of:

excavating a hole in the ground of sufficient size to contain a vault of the desired capacity;

positioning within said hole a vault, comprising:

a bottom defining an interior bottom surface; and a pair of opposing upstanding walls;

positioning a pre-fabricated storage vessel within said vault;

attaching a bottom restraint to said bottom surface of said vault;

positioning a structural member above and across said storage vessel, said structural member comprising:

a beam;

a first depending restraint positioned to one side of said beam; and a second depending restraint positioned to an opposing side of said beam, wherein said first depending restraint and said second depending restraint are spaced apart along the length of said beam a distance not less than the width of said storage vessel to sandwich said storage vessel between said first restraint and said second restraint; attaching said structural member to said pair of walls of said vault; and positioning at least one spacer between said storage vessel and one of said vault walls to restrain said storage vessel horizontally in one direction.

15. The method of claim 12, further comprising the step of coupling said bottom restraint to said storage vessel.

16. The method of claim 13, wherein said coupling said bottom restraint to said storage vessel is performed before said positioning said storage vessel within said vault.

17. The method of claim 12, wherein said positioning of said structural member comprises:

positioning said beam generally perpendicular to said pair of opposing vault walls;

positioning said first depending restraint adjacent one side of said storage vessel; and positioning said second depending restraint adjacent an opposing side of said storage vessel, such that said first restraint and said second restraint are not in structural contact with said storage vessel, wherein after said positioning of said structural member, said first restraint restricts horizontal movement of said storage vessel relative to said vault in one direction and said second restraint restricts horizontal movement of said storage vessel in the opposite direction.

18. A method of constructing an underground storage system, comprising the steps of:

excavating a hole in the ground of sufficient size to contain a vault of the desired capacity;

positioning within said hole a vault, comprising:

a bottom defining an interior bottom surface; and a pair of opposing upstanding walls;

positioning a pre-fabricated storage vessel within said vault;

attaching a bottom restraint to said bottom surface of said vault;

positioning a structural member above and across said storage vessel, said structural member comprising:

a beam;

a first depending restraint positioned to one side of said beam; and a second depending restraint positioned to an opposing side of said beam, wherein said first depending restraint and said second depending restraint are spaced apart along the length of said beam a distance not less than the width of said storage vessel to sandwich said storage vessel between said first restraint and said second restraint;

attaching said structural member to said pair of walls of said vault, wherein said positioning of said structural member comprises:

positioning said beam generally perpendicular to said pair of opposing vault walls;

positioning said first depending restraint adjacent one side of said storage vessel; and positioning said second depending restraint adjacent an opposing side of said storage vessel, such that said first restraint and said second restraint are not in structural contact with said storage vessel, wherein after said positioning of said structural member, said first restraint restricts horizontal movement of said storage vessel relative to said vault in one direction and said second restraint restricts horizontal movement of said storage vessel in the opposite direction; and positioning said beam above said storage vessel such that said beam is in frictional contact with said storage vessel.

19. A method of constructing an underground storage system, comprising the steps of:

excavating a hole in the ground of sufficient size to contain a vault of the desired capacity;

positioning within said hole a vault, comprising:

a bottom defining an interior bottom surface; and a pair of opposing upstanding walls;

positioning a pre-fabricated storage vessel within said vault;

attaching a bottom restraint to said bottom surface of said vault;

positioning a structural member above and across said storage vessel, said structural member comprising:

a beam;

a first depending restraint positioned to one side of said beam; and a second depending restraint positioned to an opposing side of said beam, wherein said first depending restraint and said second depending restraint are spaced apart along the length of said beam a distance not less than the width of said storage vessel to sandwich said storage vessel between said first restraint and said second restraint;

attaching said structural member to said pair of walls of said vault, wherein said positioning of said structural member comprises:

positioning said beam generally perpendicular to said pair of opposing vault walls;

positioning said first depending restraint adjacent one side of said storage vessel; and positioning said second depending restraint adjacent an opposing side of said storage vessel, such that said first restraint and said second restraint are not in structural contact with said storage vessel, wherein after said positioning of said structural member, said first restraint restricts horizontal movement of said storage vessel relative to said vault in one direction and said second restraint restricts horizontal movement of said storage vessel in the opposite direction; wherein said positioning of said beam is performed simultaneously with said positioning of said first and said second depending restraints.

20. The method of claim 12, wherein the step of attaching said structural member to said pair of opposing walls comprises:

aligning each end of said structural member with at least one of a plurality of connector inserts embedded within each of said opposing vault walls;

inserting a fastener through an opening on said structural member; and inserting said fastener into said connector inserts within said vault walls.

21. The method of claim 12, further comprising the step of positioning a shim plate between the end of said structural member and one of said vault walls, said shim plate comprising a thickness sufficient to cover any distance between said end of said structural member and said vault wall.

22. An underground storage system, comprising:

a vault, comprising:

a generally rectangular bottom;

a first pair of opposing upstanding walls;

a second pair of opposing upstanding walls, said bottom, said first pair of walls and said second pair of walls cooperating to form a box-shaped container having an open upper end; and a top covering said open upper end;

a storage vessel positioned within said vault; and a structural member positioned within said vault, said structural member comprising:

a first depending restraint; and a second depending restraint, wherein said depending restraints are attached only to said structural member, such that said first depending restraint restricts horizontal movement of said storage vessel relative to said vault in one direction and said second depending restraint restricts horizontal movement of said storage vessel in the opposite direction.

23. The storage system of claim 22, wherein said structural member is positioned above and across said storage vessel, generally parallel to said second pair of walls.

24. The storage system of claim 22, further comprising a plurality of bottom restraints attached to said bottom of said vault and positioned alongside said storage vessel such that in the event of horizontal movement of said storage vessel, said storage vessel contacts said bottom restraints to prevent further movement of said storage vessel in that direction.

25. An underground storage system, comprising:

a vault, comprising:

a generally rectangular bottom;

a first pair of opposing upstanding walls;

a second pair of opposing upstanding walls, said bottom, said first pair of walls and said second pair of walls cooperating to form a box-shaped container having an open upper end; and a top covering said open upper end;

a storage vessel positioned within said vault, wherein said vault is sized and shaped and said vessel is positioned relative said vault such that there is sufficient space between said storage vessel and said vault such that an adult can move along at least two of said walls of said vault to visually inspect each of the sides of said storage vessel; and a structural member positioned within said vault, said structural member comprising:

a first depending restraint; and a second depending restraint, such that said first depending restraint restricts horizontal movement of said storage vessel relative to said vault in one direction and said second depending restraint restricts horizontal movement of said storage vessel in the opposite direction;

a plurality of bottom restraints attached to said bottom of said vault and positioned alongside said storage vessel such that in the event of horizontal movement of said storage vessel, said storage vessel contacts said bottom restraints to prevent further movement of said storage vessel in that direction; and at least one spacer positioned between said storage vessel and one of said first pair of vault walls to restrain horizontal movement in one direction.

26. The storage system of claim 24, wherein said bottom restraints are fixed to said storage vessel to restrict movement in either horizontal direction.

27. The storage system of claim 24, wherein said bottom restraints are positioned along two opposing sides of said storage vessel, and not connected to said storage vessel, to wedge said storage vessel in place.

28. A method of constructing an underground storage system, comprising the steps of:

excavating a hole in the ground of sufficient size to contain a vault of the desired capacity;

positioning within said hole a vault, comprising:

a bottom defining an interior bottom surface;

a first pair of opposing upstanding walls; and a second pair of opposing upstanding walls;

positioning a storage vessel within said vault, wherein said positioning of said vessel is performed such that there is sufficient space between said storage vessel and said vault that an adult can move along at least two of said walls between said vessel and said vault to visually inspect each of said sides of said storage vessel;

positioning a structural member within said vault across said storage vessel, said structural member comprising:

a first depending restraint on one side of said structural member; and a second depending restraint, wherein said first depending restraint and said second depending restraint are spaced apart a sufficient distance so that after said positioning of said structural member, said storage vessel is sufficiently wedged between said first depending restraint and said second depending restraint to generally restrict horizontal movement of said storage vessel relative to said vault in a first direction and in a second, opposite direction; and attaching said structural member to said first pair of walls of said vault.

29. The method of claim 28, wherein said positioning of said structural member comprises:

positioning said beam generally parallel to said second pair of vault walls;

positioning said first depending restraint in close proximity to one side of said storage vessel; and positioning said second depending restraint in close proximity to the opposite side of said storage vessel.

30. The method of claim 28, further comprising attaching a bottom restraint to said bottom surface of said vault.

31. The method of claim 28, wherein said attaching said bottom restraint to said bottom surface of said vault is performed before said positioning of said vessel within said vault.

32. The method of claim 28, further comprising attaching said bottom restraint to said storage vessel.

33. The method of claim 30, wherein the step of attaching said bottom restraint to said storage vessel is performed before said positioning of said vessel within said vault.

34. An underground storage system, comprising:

a vault, comprising:

a pre-fabricated cup-shaped bottom unit, comprising:

a generally rectangular bottom;

a first pair of generally opposing upstanding wall portions; and a second pair of generally opposing upstanding wall portions, said bottom, said first pair of wall portions and said second pair of wall portions cooperating to form a box-shaped container having an open end, a generally rectangular horizontal cross-section and a generally rectangular vertical cross-section; and at least one pre-fabricated collar unit, comprising:

a first pair of generally opposing upstanding wall sections; and a second pair of generally opposing upstanding wall sections, said first pair of wall sections and said second pair of wall sections cooperating to form a box-shaped tube having an open upper end, an open lower end, a generally rectangular horizontal cross-section and a generally rectangular vertical cross-section; and a pre-fabricated top unit, said top unit sized and shaped to cover said open upper end of said collar unit;

a pre-fabricated storage vessel positioned within said vault;

at least one structural member positioned above and across said storage vessel, said structural member comprising:

a first depending restraint; and a second depending restraint, said first restraint and said second restraint spaced apart such that said first restraint restricts horizontal movement of said storage vessel relative to said vault in one direction and said second restraint restricts horizontal movement of said storage vessel in the opposite direction.

35. The storage system of claim 34, wherein said structural member is situated across said storage vessel such that said first depending restraint is adjacent one side of said storage vessel and said second restraint is adjacent an opposing side of said storage vessel.

36. The storage system of claim 34, wherein said first depending restraint and said second depending restraint each comprise a planar surface parallel to said storage vessel.

37. An underground storage system, comprising:

a vault;

a storage vessel having an upper surface, positioned within said vault; and a structural member positioned within said vault, above and across said storage vessel, said structural member comprising a beam having a lower surface, wherein said lower surface of said beam is in frictional contact with said upper surface of said storage vessel to restrict movement of said storage vessel relative to said vault.

38. The storage system of claim 37, further comprising a first depending restraint attached to said beam and a second depending restraint attached to said beam, said first restraint restricting horizontal movement of said storage vessel relative to said vault in one direction and said second restraint restricting horizontal movement of said storage vessel in the opposite direction.

39. The storage system of claim 38, wherein said first depending restraint and said second depending restraint are not fixed to said storage vessel.

* * * * *